US011089911B1

(12) United States Patent
Battleson

(10) Patent No.: US 11,089,911 B1
(45) Date of Patent: Aug. 17, 2021

(54) SHOWER CURTAIN LINER ASSEMBLIES AND RELATED METHODS

(71) Applicant: James Eric Battleson, Cape Coral, FL (US)

(72) Inventor: James Eric Battleson, Cape Coral, FL (US)

( * ) Notice: Subject to any disclaimer, the term of this patent is extended or adjusted under 35 U.S.C. 154(b) by 0 days.

(21) Appl. No.: 16/733,181

(22) Filed: Jan. 2, 2020

Related U.S. Application Data

(60) Provisional application No. 62/894,960, filed on Sep. 2, 2019, provisional application No. 62/788,832, filed on Jan. 5, 2019.

(51) Int. Cl.
*A47K 3/38* (2006.01)

(52) U.S. Cl.
CPC ..... *A47K 3/38* (2013.01)

(58) Field of Classification Search
CPC ..... A47K 3/38
USPC ..... 4/608
See application file for complete search history.

(56) References Cited

U.S. PATENT DOCUMENTS 3,382,507 A * 5/1968 Micheau ..... A47K 3/38 4/558
5,007,120 A * 4/1991 Annand ..... A47K 3/38 4/558
5,771,504 A * 6/1998 Steiner ..... A47K 3/38 4/558
D676,947 S * 2/2013 Peede ..... D23/304
10,835,083 B2 * 11/2020 Raymond ..... A47K 3/38
2011/0094686 A1 * 4/2011 Kee ..... A47K 3/34 160/102
2016/0045080 A1 2/2016 Royal
2019/0282036 A1 9/2019 Johnson
2019/0282037 A1 9/2019 Johnson
2020/0329921 A1 * 10/2020 Raymond ..... A47H 13/02

OTHER PUBLICATIONS

Melissa Cook, "How to Stop Your Shower Curtain From Blowing In," published online at least a early as Dec. 30, 2018, available at http://stopyourshowercurtainblowingin.blogspot.com/2013/06/heres-how-to-stop-your-shower-curtain.html?m=1, last visited Mar. 30, 2020.

(Continued)

*Primary Examiner* — Jeremy Carroll
(74) *Attorney, Agent, or Firm* — Law Office of Paul B. Johnson; Paul B. Johnson

(57) ABSTRACT

Shower curtain liner assemblies include a shower curtain liner with a plurality of openings for hanging the shower curtain liner from a shower rod. A plurality of rigid members are included in the assembly. In implementations a plurality of couplers coupled with the shower curtain liner are configured to couple the rigid members to the liner in a vertical configuration so that a longest length of each rigid member is perpendicular to the shower rod when the shower curtain liner is hanging from the shower rod. In implementations the rigid members are permanently integrally formed in the shower curtain liner itself. In implementations each rigid member includes a first angled portion and a vertical portion below the first angled portion. In implementations a lowermost extremity of each rigid member abuts an outside surface of a tub. In implementations each rigid member includes an opening for hanging on a shower rod.

20 Claims, 33 Drawing Sheets

(56) References Cited

OTHER PUBLICATIONS

"Clingless Curtain Keeper, Diamond Chrome, Shower Curtain Liner Solution, Set of 3," on sale in the U.S. at least as early as Dec. 30, 2018, available at https://www.amazon.com/Clingless-Curtain-Keeper-Christmas-Shower/dp/B078273WVP, last visited Mar. 30, 2020.

Curvit Shower Curtain Rings, on sale in the U.S. by Curvit at least as early as Jan. 4, 2019, available at https://www.amazon.com/dp/B00U6P17V0//ref=cm_sw_su_dp?tag=dudetxte-20—, last visited Mar. 30, 2020.

Screenshot from "Clingless~Solves Shower Curtain Cling (Demo)" Youtube video, published online at least as early as Aug. 19, 2016, available at https://youtu.be/S2wGrlot02k, last visited Mar. 30, 2020.

* cited by examiner

SHOWER CURTAIN LINER ASSEMBLIES AND RELATED METHODS

CROSS REFERENCE TO RELATED APPLICATIONS

This document claims the benefit of the filing date of U.S. Provisional Patent Application No. 62/788,832, entitled "Shower Curtain Liner Assemblies and Related Methods," naming as first inventor James Eric Battleson, which was filed on Jan. 5, 2019, and further claims the benefit of the filing date of U.S. Provisional Patent Application No. 62/894,960, entitled "Shower Curtain Assemblies and Related Methods," naming as first inventor James Eric Battleson, which was filed on Sep. 2, 2019, the disclosures of each of which are hereby incorporated entirely herein by reference.

BACKGROUND

1. Technical Field

Implementations of shower curtain liner assemblies and related methods relate to devices and methods for shaping a shower curtain/liner to a desired shape.

2. Background Art

Shower curtain holders exist in the art. Some devices exist for holding a shower curtain in a shape other than a strictly vertical shape.

SUMMARY

Implementations of shower curtain liner assemblies may include: a shower curtain liner having a plurality of openings configured to be used to hang the shower curtain liner from a shower rod; a plurality of rigid members; and a plurality of couplers coupled with the shower curtain liner and configured to couple the rigid members to the shower curtain liner in a vertical configuration so that a longest length of each rigid member is perpendicular to the shower rod when the shower curtain liner is hanging from the shower rod; wherein each rigid member includes a first angled portion and a vertical portion and wherein, when the rigid member is coupled with one or more of the couplers and when the shower curtain liner is hanging from the shower rod: the first angled portion is angled away from an interior of a shower; the shower curtain liner is positioned away from the interior of the shower by the first angled portion; the vertical portion is parallel with a sidewall of a tub of the shower; and the vertical portion is positioned further from the shower rod than the first angled portion.

Implementations of shower curtain liner assemblies may include one or more or all of the following:

The first angled portion of each rigid member may be adjustable within a range of angles using a variable-angled connector connecting a first portion of the rigid member and a second portion of the rigid member.

When each rigid member is coupled with one or more of the couplers and when the shower curtain liner is hanging from the shower rod, a lowermost extremity of each rigid member may abut an outside surface of the tub.

The shower curtain liner assembly may include no horizontal rigid members having a longest length parallel with the shower rod.

At least one of the rigid members may have a second angled portion and, when each rigid member is coupled with one or more of the couplers and when the shower curtain liner is hanging from the shower rod, the second angled portion may be positioned further from the shower rod than the vertical portion of the at least one rigid member, the second angled portion may be angled towards the tub, and a lowermost extremity of the second angled portion may abut an outside surface of the tub.

When each rigid member is coupled with one or more of the couplers and when the shower curtain liner is hanging from the shower rod, none of the rigid members may include a second angled portion positioned further from the shower rod than its vertical portion.

Each rigid member may have an opening configured to be used to hang the rigid member from the shower rod.

Each rigid member may include a loop, wherein the loop is configured to hang from one of the shower rod and an element looped around the shower rod.

At least one of the rigid members may include a hook member configured to hang the shower curtain liner and/or a shower curtain thereon.

Each rigid member may include a head atop a narrow neck, wherein the head is configured to retain the narrow neck of the rigid member within a slot of the shower rod.

A greatest width of the shower curtain liner may be shorter than a greatest width of the shower so that, when the shower curtain liner is fully expanded, distal sides of the shower curtain liner do not touch any walls of the shower.

The couplers may include sleeves, hook-and-loop fasteners, and/or straps.

The shower curtain liner may include two corner portions angled inward towards the shower when the shower curtain liner is hanging from the shower rod, the corner portions forming an angle between 60 and 120 degrees with a largest planar surface of the shower curtain liner in a fully expanded configuration.

The shower curtain liner may include side panels angled inward towards the shower when the shower curtain liner is hanging from the shower rod, the side panels forming an angle between 60 and 120 degrees with a largest planar surface of the shower curtain liner in a fully expanded configuration, the side panels existing along more than half of a longest vertical length of the shower curtain liner.

Implementations of shower curtain liner assemblies may include: a shower curtain liner having a plurality of openings configured to be used to hang the shower curtain liner from a shower rod; a plurality of rigid members; and a plurality of couplers coupled with the shower curtain liner and configured to couple the rigid members to the shower curtain liner in a vertical configuration so that a longest length of each rigid member is perpendicular to the shower rod when the shower curtain liner is hanging from the shower rod; wherein the shower curtain liner includes two corner portions angled inward towards a shower when the shower curtain liner is hanging from the shower rod, the corner portions forming an angle between 60 and 120 degrees with a largest planar surface of the shower curtain liner in a fully expanded configuration; and wherein, when each rigid member is coupled with one or more of the couplers and when the shower curtain liner is hanging from the shower rod, a lowermost extremity of each rigid member abuts an outside surface of a tub of the shower.

Implementations of shower curtain liner assemblies may include one or more or all of the following:

The shower curtain liner may include side panels angled inward towards the shower when the shower curtain liner is hanging from the shower rod, the side panels forming an angle between 60 and 120 degrees with the largest planar surface of the shower curtain liner in the fully expanded configuration, the side panels existing along more than half of a longest vertical length of the shower curtain liner.

Each rigid member may include a first angled portion and a vertical portion and, when the rigid member is coupled with one or more of the couplers and when the shower curtain liner is hanging from the shower rod: the first angled portion may be angled away from an interior of the shower; the shower curtain liner may be positioned away from the interior of the shower by the first angled portion; the vertical portion may be parallel with a sidewall of the tub; and the vertical portion may be positioned further from the shower rod than the first angled portion.

Implementations of shower curtain liner assemblies may include: a shower curtain liner; a plurality of thick portions permanently integrally formed in the shower curtain liner, each thick portion forming a rigid member of the shower curtain liner; and a plurality of openings formed in the shower curtain liner configured to facilitate hanging of the shower curtain liner from a shower rod; wherein, when the shower curtain liner is hanging from the shower rod, each rigid member positions a portion of the shower curtain liner away from an interior of a shower.

Implementations of shower curtain liner assemblies may include one or more or all of the following:

When the shower curtain liner is hanging from the shower rod, a lowermost extremity of each rigid member may abut an outside surface of a tub of the shower.

Each rigid member may include a first angled portion and a vertical portion and, when the shower curtain liner is hanging from the shower rod: the first angled portion may be angled away from the interior of the shower; the vertical portion may be parallel with a sidewall of a tub of the shower; and the vertical portion may be positioned further from the shower rod than the first angled portion.

General details of the above-described implementations, and other implementations, are given below in the DESCRIPTION, the DRAWINGS, and the CLAIMS.

BRIEF DESCRIPTION OF THE DRAWINGS

Implementations will be discussed hereafter using reference to the included drawings, briefly described below, wherein like designations refer to like elements.

DESCRIPTION

Implementations/embodiments disclosed herein (including those not expressly discussed in detail) are not limited to the particular components or procedures described herein. Additional or alternative components, assembly procedures, and/or methods of use consistent with the intended shower curtain liner assemblies and related methods may be utilized in any implementation. This may include any materials, components, sub-components, methods, sub-methods, steps, and so forth.

Implementations of shower curtain liner assemblies and related methods relate to devices and methods for shaping a shower curtain/liner to a desired shape.

Implementations of shower curtain liner assemblies disclosed herein perform the functions of preventing the shower curtain/liner from touching the body of a user while the user is showering and creating additional space/volume within the shower. In implementations this resolves the issue of cramped space and/or a large or obese person using a shower that is sized small (or small relative to the user). For example users who would benefit from a larger shower but who cannot afford a larger shower or who cannot fit a larger shower within the bathroom size may benefit from the shower curtain liner assemblies disclosed herein. For such users, if a conventional shower curtain/liner is used the liner may be pushed out of the shower tub and water may leak on the floor, and the user may be uncomfortable with the shower curtain liner touching them—which may also make it difficult to shower. Users also do not want to be touched by the liner for hygienic purposes, such as to avoid bacteria and mold and the like. Shower curtain liner assemblies disclosed herein address these issues, and users may also benefit from the disclosed shower curtain liner assemblies in other ways, as the practitioner of ordinary skill in the art will understand from the description and the drawings.

Figure 1:
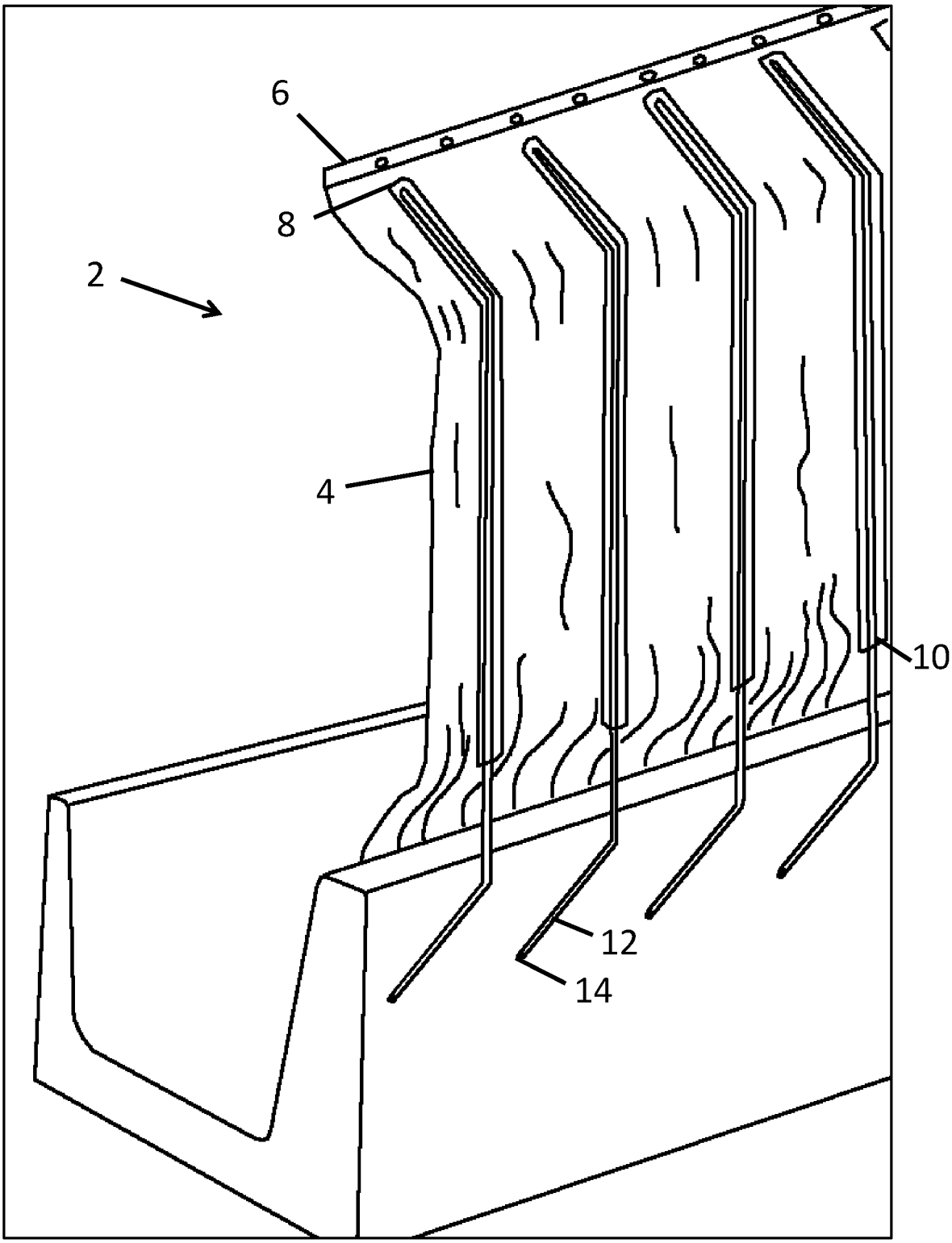
FIG. 1 is a perspective view of an implementation of a shower curtain liner assembly.

Referring now to FIG. 1, which is a perspective view of elements of a representative example of shower curtain liner assembly (assembly) 2, a shower curtain liner (liner) 4 is shown. The top 6 of the liner includes grommet holes. Rings can couple with the grommet holes so that the liner can be coupled with a conventional shower rod, which may be any conventional shower rod (the shower rod is not shown in FIG. 1). The liner in the implementation shown includes a number of vertical sleeves 8 extending down the liner, and inserted into each sleeve is a rigid member 12 which forces the liner to be pulled away from the center of the tub/shower (the rigid members may also be called braces, or brackets, or ribs). This has the effect of creating more space within the shower area, and also allows a user to shower/bathe without the curtain touching the user. In the implementation shown the rigid members pull the liner outward in such a way that up to 12 inches of additional space are created. Nevertheless, this is just a representative example of how much space might be created—in implementations more or less additional space may be created, such as 6-25 inches or other dimensions. The number of sleeves and associated rigid members may be adjusted as desired and may be more or less than is shown in the drawings, in implementations.

The rigid members may be spaced evenly, as shown in FIG. 1, though in other implementations there could be some uneven spacings (for example more or fewer proximate the edges). Each sleeve has an opening 10 and the bottom end of the rigid member in each case projects down through the opening. A cushion 14 is placed at the lowest end of the rigid member so that the rigid members may slide along the outside of the tub wall without scraping, scratching, or otherwise damaging it. The cushion may in implementations be formed of a polymer such as, by non-limiting example, a rubber material.

When the liner is in place a shower curtain may be placed on the rod as well, and the curtain may be configured to have a lowermost end that fully conceals the lower ends of the rigid members. As with conventional shower curtains and liners, the curtain may provide a decorative exterior (and/or may provide opacity for privacy) having a lowermost end outside the tub/shower, while the liner may be opaque or clear and may be draped within the tub/shower to prevent water from escaping the tub/shower. The liner may be formed of polymers, fabric/cloth, and so forth, as with conventional liners. The shower curtain, not shown in FIG. 1, may also be made of polymer, fabric/cloth, or other materials as are used for conventional curtains.

The rigid members may be made of any rigid material, such as a rigid polymer, a metal, a composite, a wood element, bamboo, and so forth. The rigid member in implementations may be made of plastic that is extruded into a pole or other shape and then heated and bent at the appropriate places. Each rigid member may be shaped as a single piece or may have separate pieces that connect within the liner to pull the liner away from the inside of the shower/tub. In the implementation shown in FIG. 1 the rigid members form an angular shape, with each rigid member having a top short angled member angling away from the shower/tub, a middle long vertical member, and a bottom short angled member angling towards the shower/tub. In some implementations the top short angled member and bottom short angled member may be the same size, though in other implementations they could be different sizes.

The rigid members may remain in their outward configuration due to their being situated within the sleeves, during the opening and closing of the curtain and/or liner, in some implementations. In other implementations the rigid members may turn to one side or the other when the liner/curtain is slid to a side (i.e., fully or partially collapsed), so that the liner/curtain are not in the way of anything when not in use. In some implementations the rigid members work in concert to retain the shape shown in FIG. 1. For example, in some implementations when the liner/curtain is pulled taut to the position shown in FIG. 1 the rigid members settle into place in the configuration shown (in other words when the curtain/liner is taut they are biased towards the positions shown in FIG. 1 pulling the liner outward from the shower), while when the liner is no longer taut the rigid members are no longer biased towards the positions shown but instead settle to one side or another, laying/lying to the side, to take up less space (this may be the case with other liners disclosed herein). In implementations the liner needs to be a bit narrower than the width of the shower in order for it to be pulled taut so that the rigid members will be biased to the positions shown in FIG. 1. In implementations the shower curtain/liner may be sized to accomplish this, which may be accomplished by removing a portion of the sides of an existing rectangular liner as described below with respect to FIG. 7A (in which a triangular portion having a width of 8 inches is removed from each end). In implementations one side of the liner/curtain may be coupled with a wall of the shower, such as with a rubber band or elastic element coupled with a suction cup or hook or other element on the wall, as non-limiting examples, so that when the other side of the liner is pulled the entire liner pulls taut (i.e., so that the user can pull the curtain/liner taut with one hand). In implementations there could be suction cups or other couplers on both ends but in implementations having suction cups or other couplers on both ends adds extra steps to use the curtain (the user having to attach one coupler to close the curtain then remove it to open the curtain again), so in implementations it may be easier for the end user to only have a suction cup or other coupler on one end only.

Figure 9:
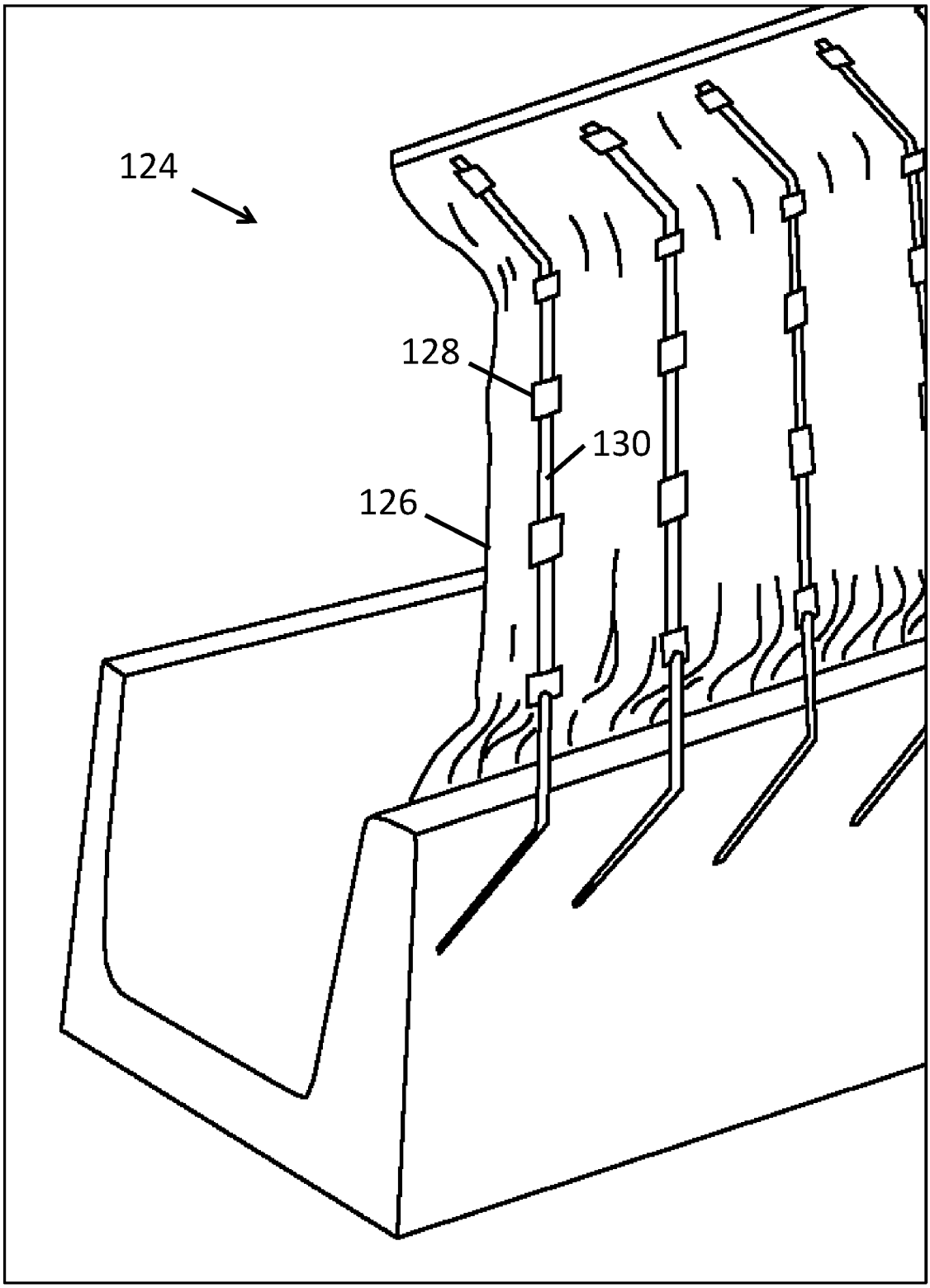
FIG. 9 is a perspective view of an implementation of a shower curtain liner assembly.

The rigid members are coupled with the liner, but in implementations the actual mechanism of the coupling, or the type of coupling, may be varied. In the implementation of FIG. 1 the coupling is through the use of sleeves, as shown. In other implementations the rigid members could be adhered to the liner using an adhesive, or sewn to the liner, or magnetically coupled with the liner, held onto the liner using straps or bands (such as rubber bands or another elastic or similar member or ropes or cloth or polymer strap members), tied to the liner, taped to the liner, and so forth. For example, FIG. 9 shows an example where, instead of long sleeves, shorter bands are used to couple the rigid member with the liner. These bands may be formed of an elastic material, such as a rubber material, or an elastic fabric or the like. The bands may be sleeves, but shorter than the sleeves of FIG. 1, and as indicated they may be elastic to hold the rigid members secure to the liner. In other implementations the bands could have hook-and-loop fasteners for securing the rigid member to the liner. In other implementations ties such as cords or rope or the like could be used to couple the liner with the rigid members (for example just tightened around the rigid members, or tightened around narrower sections of the rigid members to prevent up and down movement of the rigid members, or tying through openings/holes in the rigid members to secure the rigid members in place).

Figure 2:
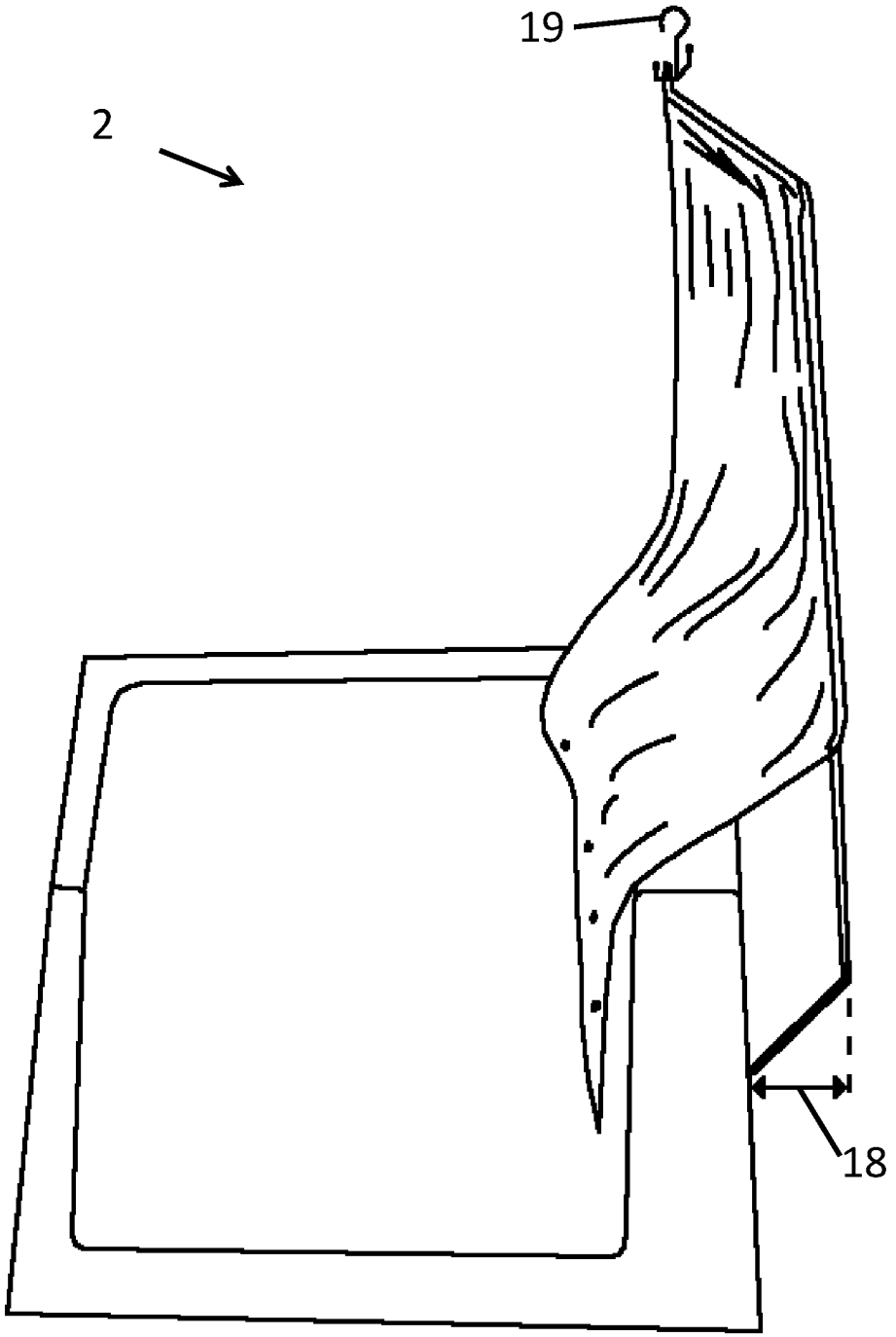
FIG. 2 is a side view of the shower curtain liner assembly of FIG. 1.

FIG. 2 shows a side view of the implementation of FIG. 1 with representative dimension 18 detailed, which is a 3 inch gap from the outside edge of the tub to the rigid member(s). In this implementation there is also an 8 inch gap from the inside edge of the tub to the rigid member(s) (this dimension is not called out in the drawing). These are only examples of dimensions, however, and other implementations may have other dimensions. FIG. 2 also shows a hook member 19 that may be used to hang the shower curtain liner and a shower curtain on a shower rod. The hook member has an inner hook element, on which the liner of FIG. 2 is hanging (using a hole/opening at the top 6 of the liner), and the hook member also has an outer hook element on which nothing is shown hanging in FIG. 2, but on which a curtain may be hung to drape outside the tub (and cover the rigid members).

Figure 3:
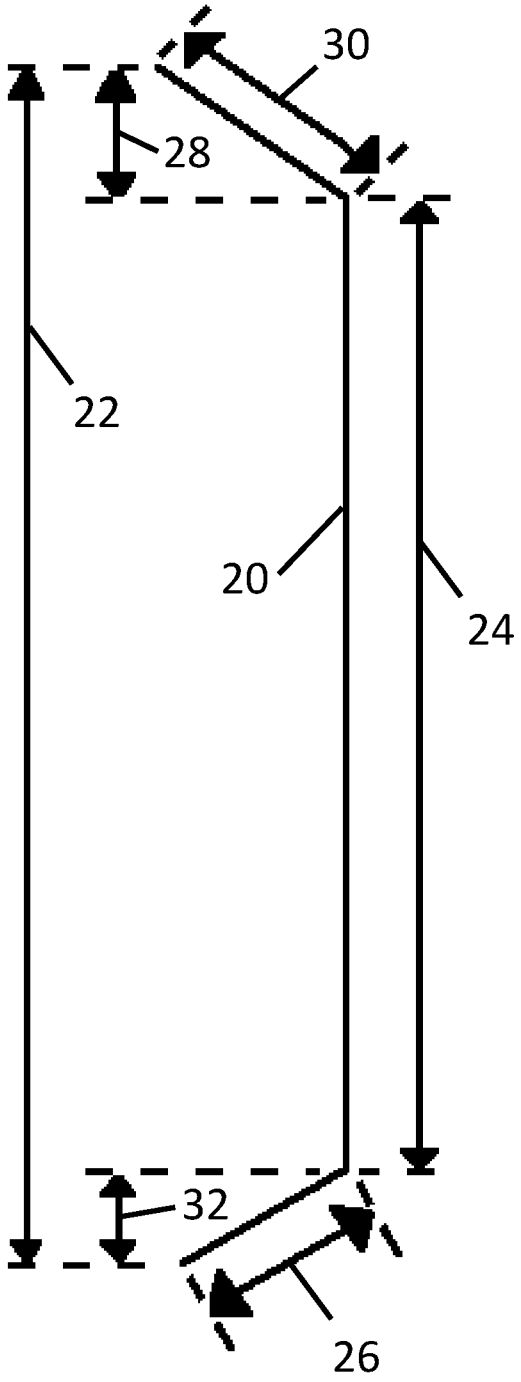
FIG. 3 is a side view of an implementation of a rigid member.

FIG. 3 shows a simplified side view of an implementation of a rigid member 20 illustrating example dimensions and angles. The top angled portion is seen to have a dimension 30 of 6.6875 inches (the vertical component of which, dimension 28, is 3.875 inches) and to form an angle of 35 degrees with the middle vertical portion. The middle vertical portion has a dimension 24 of 56.375 inches. The bottom angled portion is seen to have a dimension 26 of 4.875 inches (the vertical component of which, dimension 32, is 2.75 inches) and to form an angle of 35 degrees with the middle vertical portion. The vertical length of the entire rigid member, dimension 22, is 63 inches. The rigid member is shown in simplified form, as a stick element, though in reality it would have a diameter (such as having a cylindrical or rectangular cuboid or cylindrical or rectangular or triangular tube shape, or some other shape—for example having a cross section of a circle, square, rectangle, triangle, any n-sided polygon, any other regular or irregular shape, hollow or non-hollow, etc.). The rigid member of FIG. 3 is formed of plastic but it could also be formed of another material as already stated.

Although some rigid members in the drawings are shown as having the angled configuration shown (for example a top angled member, a middle vertical member, and a bottom angled member), in other implementations they could have myriad other shapes. In some implementations each rigid member could have a circular or rounded shape (such as forming a large c-shape). In others they could be angled but with more rounded edges at the angles. Other shapes and lengths/sizes could be used as well in other implementations.

Figure 4:
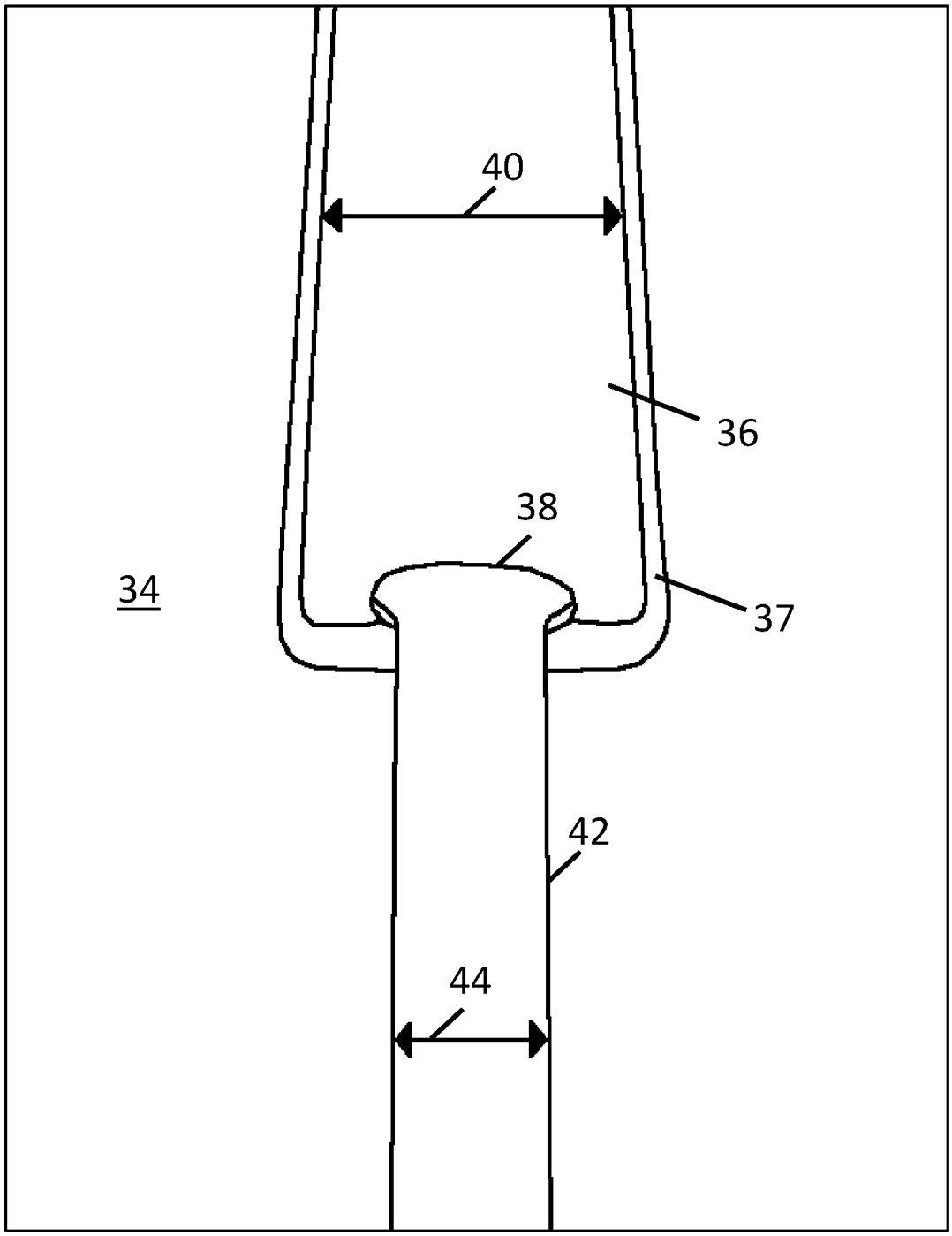
FIG. 4 is a front close-up view of elements of an implementation of a shower curtain liner assembly.

FIG. 4 shows a representative example of how a rigid member 42 may be kept within a sleeve 36 of a liner 34. The sleeve is shown here having a dimension 40 which is 0.875 inches, and an opening 38 at the bottom is seen allowing a portion of the rigid member having a dimension 44 of 0.375 inches to exit (the opening accordingly having a diameter slightly greater than 0.375 inches), but not allowing a wider than 0.375 inch portion of the rigid member to exit (this opening in implementations may be about 1 inch from the bottom or bottom seam of the liner). In this way, the rigid member may be kept at a desired height/position relative to the liner. The opening could in implementations be in the liner and in other implementations (as in FIG. 4) it could be in the sleeve itself. In implementations the opening could be reinforced such as with a grommet to prevent the opening from tearing or opening more. In implementations the rigid member above the opening may immediately transition to an about 0.875 inch width. In other implementations the rigid member may gradually increase in width from about 0.375 inches to about 0.875 inches, but the portion above the hole having a width greater than 0.375 inches prevents that portion of the rigid member from sliding through the opening. These sizes are only representative examples, and in other implementations other sizes could be used. In this representative example the sleeve is coupled with the liner using a heat-sealed perimeter 37.

Figure 5:
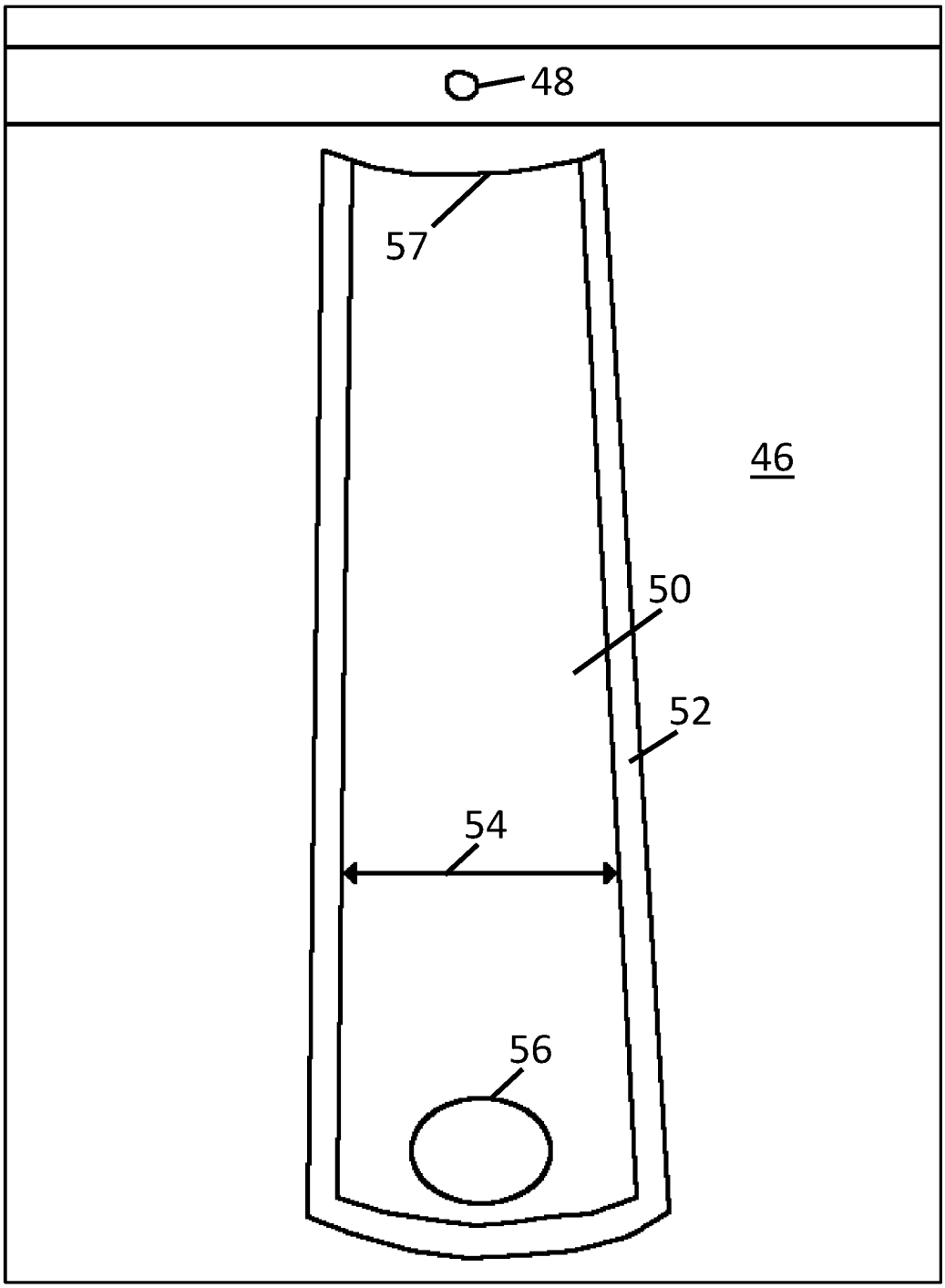
FIG. 5 is a front close-up view of an implementation of a shower curtain liner.

FIG. 5 shows a liner 46 with a sleeve 50 attached thereto, again using a heat-sealed perimeter 52. The liner is seen to have a ring hole (opening) 48 at the top aligned with the sleeve (though in other implementations the sleeves or other coupling mechanisms could be offset from the ring hole locations). The ring hole is where a ring couples with the liner to couple the liner to a shower rod. In this implementation the sleeve is fully open at the top, having an opening 57, and only heat sealed along the sides and bottom, and the opening 56 is in the liner only, not in the sleeve (so that the top of the rigid member sits 0.25 inches or so below the top of the liner but is not secured to the liner). In other implementations the opening 56 could be in the sleeve, but having the opening only in the liner allows for very easy manufacturing of the sleeve portions, they are simply strips of material that are heat sealed to the liner very quickly with straight lines. In implementations no heat seal is needed at the bottom, but heat sealing is only done down the sides of the sleeves (this saves time and expense as the heat sealing process is easier and quicker), though in FIG. 5 the bottom is shown heat-sealed as well. The sleeve in FIG. 5 is shown transparent so that the opening 56 in the sleeve may be seen. In this representative example the sleeve has a dimension 54 of 1.0625 inches wide and is 55 inches tall. These are only representative dimensions, and in other implementations other dimensions could be used. In implementations heat seals may be done with a heat gun or any other heating element.

In implementations the sleeves or other elements for coupling the rigid members may be on the outer side of the liner (facing away from the shower). In other implementations they could be on the inner side of the liner (facing toward the shower). In other implementations they could be formed within the liner (such as between and inner and outer portion of the liner). The rigid members, similarly, may be on the outer side of the liner, on the inner side of the liner, or within the liner.

Figure 6:
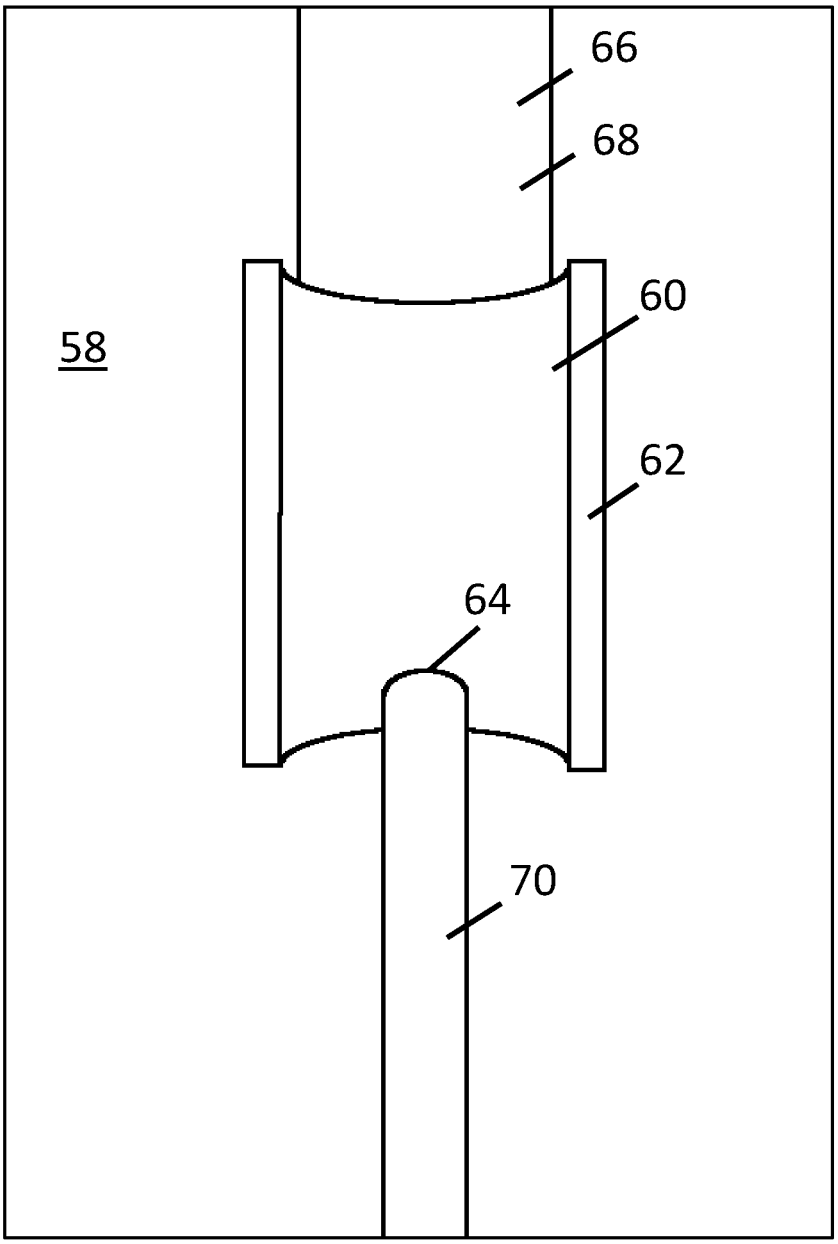
FIG. 6 is a front close-up view of elements of an implementation of a shower curtain liner assembly.

FIG. 6 shows a representative example of how, in a liner 58 which uses bands or the like (not full sleeves), such as FIG. 9, a separate reducer band 60 or element may be used as the lowermost band to allow the thin portion 70 bottom of the rigid member 66 to exit through an opening 64 (as with the aforementioned openings) and also to hold the rigid member in place. As is seen in FIG. 6 the band 60 may be a vinyl band (though in implementations it may be formed of other materials) and may be coupled with the liner using a heat-sealed perimeter 62. In the implementation shown it is heat sealed only at the sides and not at the top or bottom. The thick portion 68 of the rigid member above the opening has a larger diameter, and the thin portion of the rigid member below the opening has a smaller diameter which is sized small enough to fit through the opening, so that the opening effectively holds the rigid member at a set height. In the implementation shown the reducer band is 48 inches down from the top angled portion of the rigid member. This is only a representative dimension, however, and in other implementations the reducer band could be at a higher or lower location, and could be used with rigid members that are round, or non-angled, and so forth.

Figure 7A:
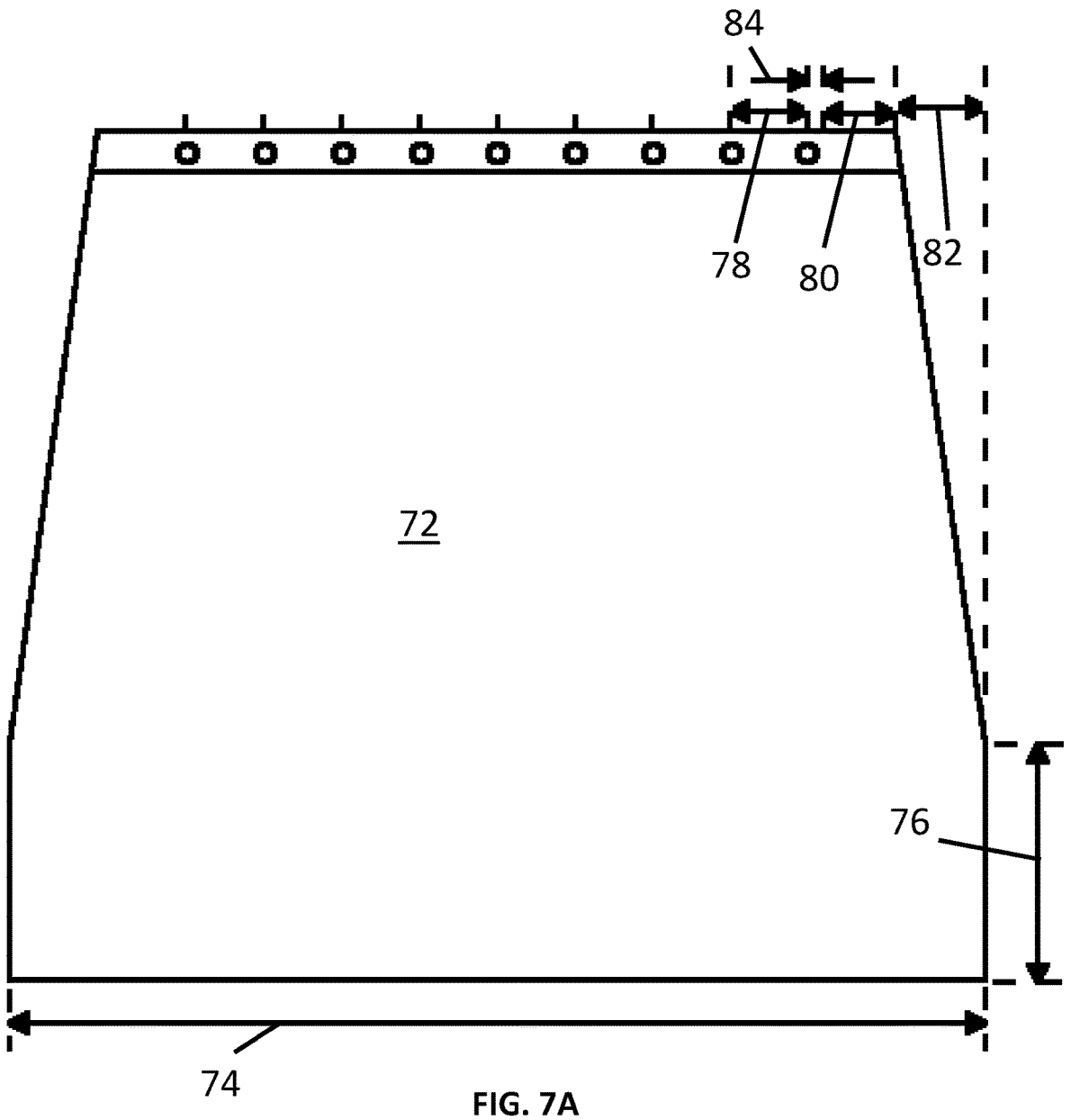
FIG. 7A is a front view of an implementation of a shower curtain liner.
Figure 7B:
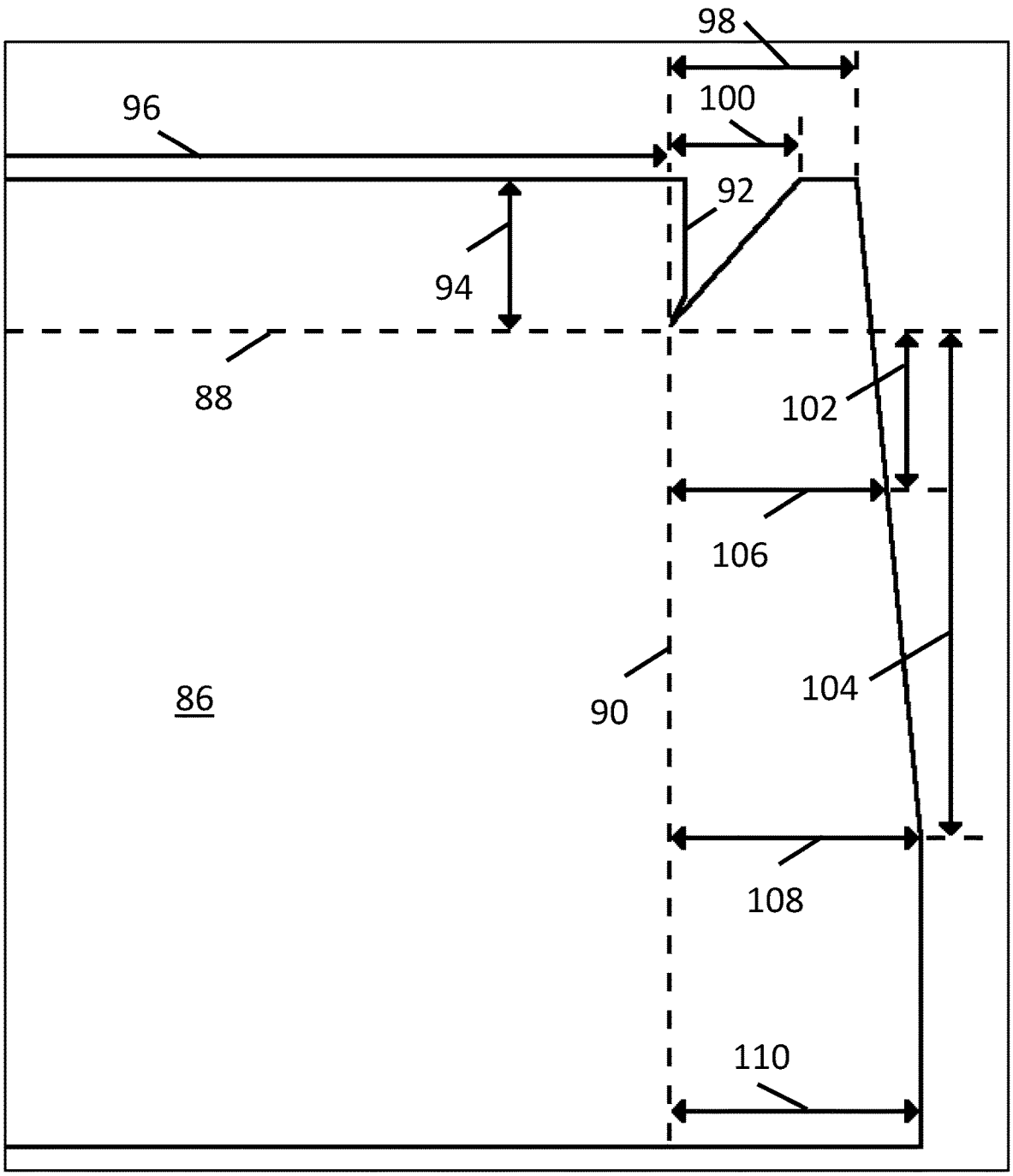
FIG. 7B is a front view of an implementation of an unfinished shower curtain liner.

In some implementations shower curtain liner assemblies are also designed so that the sides of the liner fold in, to further help prevent water from escaping outside the shower area. In implementations this is especially useful because the liner is pulled/held outward away from the shower, so that without such an inward bend water may escape the shower at the distal sides of the liner. FIGS. 7A and 7B show one representative method of creating such a bend at the sides, which is formed by removing some material from the distal sides of a rectangular liner, then making a cut near the top corner and folding in and heat sealing the edges of the cut together. Referring first to FIG. 7A, a liner 72 is shown from which a triangular section having a horizontal dimension 82 of 8 inches has been removed from each side (i.e., actually cut away) from an existing rectangular liner. The loop holes in this liner have a dimension 78 between them of 7 inches, and when the 8 inch portion is removed it also removes one loop hole. A fold having a dimension 80 of 6.5 inches will then be made after a cut is made at the 6.5 inch mark (which is a distance 84 of 1.5 inches from the center of the nearest loop hole).

The 6.5 inch dimension 80 of FIG. 7A corresponds with the 6.5 inch dimension 98 of the unfinished liner 86 of FIG. 7B. Referring to FIG. 7B, a cut is made at or near the 6.5 inch mark, and a "heat seal" portion or flap 92 is left to heat seal the two formed edges together. Representative dimensions are shown in FIGS. 7A and 7B. For example in FIG. 7A dimension 74 gives a full width which is 88 inches and dimension 76, measured from a bottom corner of the liner to where the vertical bend of the liner begins, is 21.5 inches. Referring to FIG. 7B, vertical bend 90 is shown, dimension 94 is 7.25 inches, dimension 100 is 5.5 inches, dimension 102 is 18 inches, dimension 104 is 48 inches, dimension 106 is 8.25 inches, dimension 108 is 14.25 inches, and dimension 110 is 14.25 inches. The location of the uppermost bend 88 in the rigid member and accordingly the liner is also shown in FIG. 7B. These dimensions are only one example (for example a dimension 96 of 57 inches between the cuts of the liner is shown in FIG. 7B, but in other implementations this could be 59 inches, and so forth). In other implementations, other dimensions greater or smaller could be used. A cut such as that shown in FIG. 7B may be made proximate each top corner of the liner, and the sides folded in and heat sealed at the edges of the cut to prevent water from escaping the shower. Although dimension 96 is disclosed as being 57 inches, in other implementations of liners the liners may have a horizontal width at the topmost edge of 56 inches or about 56 inches, 57 inches or about 57 inches, 58 inches or about 58 inches, or 59 inches or about 59 inches. The term "about" used in connection with these dimensions is meant to include a range of +/−1 inch.

Figure 8:
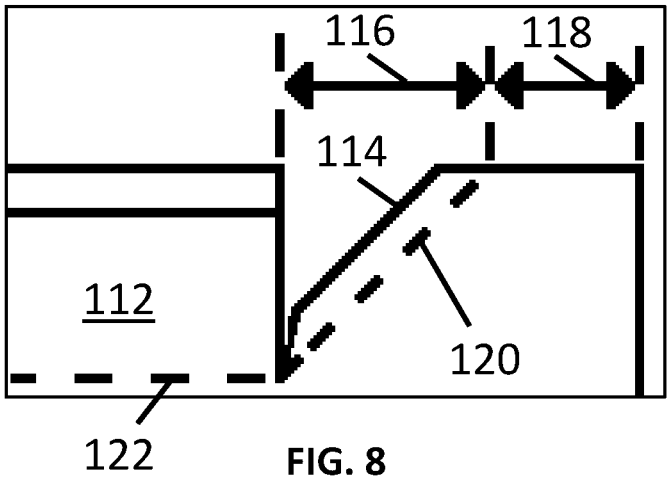
FIG. 8 is a front close-up view of an implementation of an unfinished shower curtain liner.

In FIG. 7B the heat seal area is a residual portion left after the cut, the residual portion on the side of the cut towards the center of the liner (i.e., further from the distal side of the liner). FIG. 8 shows that a heat seal area could instead (or additionally) be a residual portion left after the cut on the side of the cut towards the distal side of the liner (away from the center of the liner). FIG. 8 shows an unfinished liner 112 showing a bend 122 and a cut, but in this implementation the flap 114 is on the side of the cut towards the outer edge of the liner. A bend 120 proximate the flap it shown, and dimension 116 of 5.5 inches and dimension 118 of 6.5 inches are shown. These dimensions are, again, only examples, and in other implementations other dimensions could be used.

In implementations the cuts and heat seals of FIGS. 7A-8 make the edge of the liner form a 90 degree angle with itself, at the top of the liner, inward towards the shower. The liner below the top naturally then rests in the same inwardly curved configuration at the sides to prevent water from spilling outside the shower. This can be seen to some extent with the liner of FIG. 32. In implementations the cut that is used to make the 90 degree angle is a 35 degree cut, though in other implementations other angles of cuts and of bends could be used.

In other implementations alternative methods could be used to prevent water from spilling out the sides of the liner. For example, suction cups could be added to the sides of the liner so that the sides are secured to the shower walls snugly to avoid water spilling out. Other methods and mechanisms are possible, though as indicated not using a suction cup or other coupling mechanism on at least one end/side allows for easier opening and closing of the shower curtain liner assembly.

As described to some extent previously, FIG. 9 shows a shower curtain liner assembly (assembly) 124 which includes a liner 126 that has several bands 128 to hold the rigid members 130 in place. As discussed, these bands may be elastic or the like to hold the rigid members secure to the liner.

Figure 10:
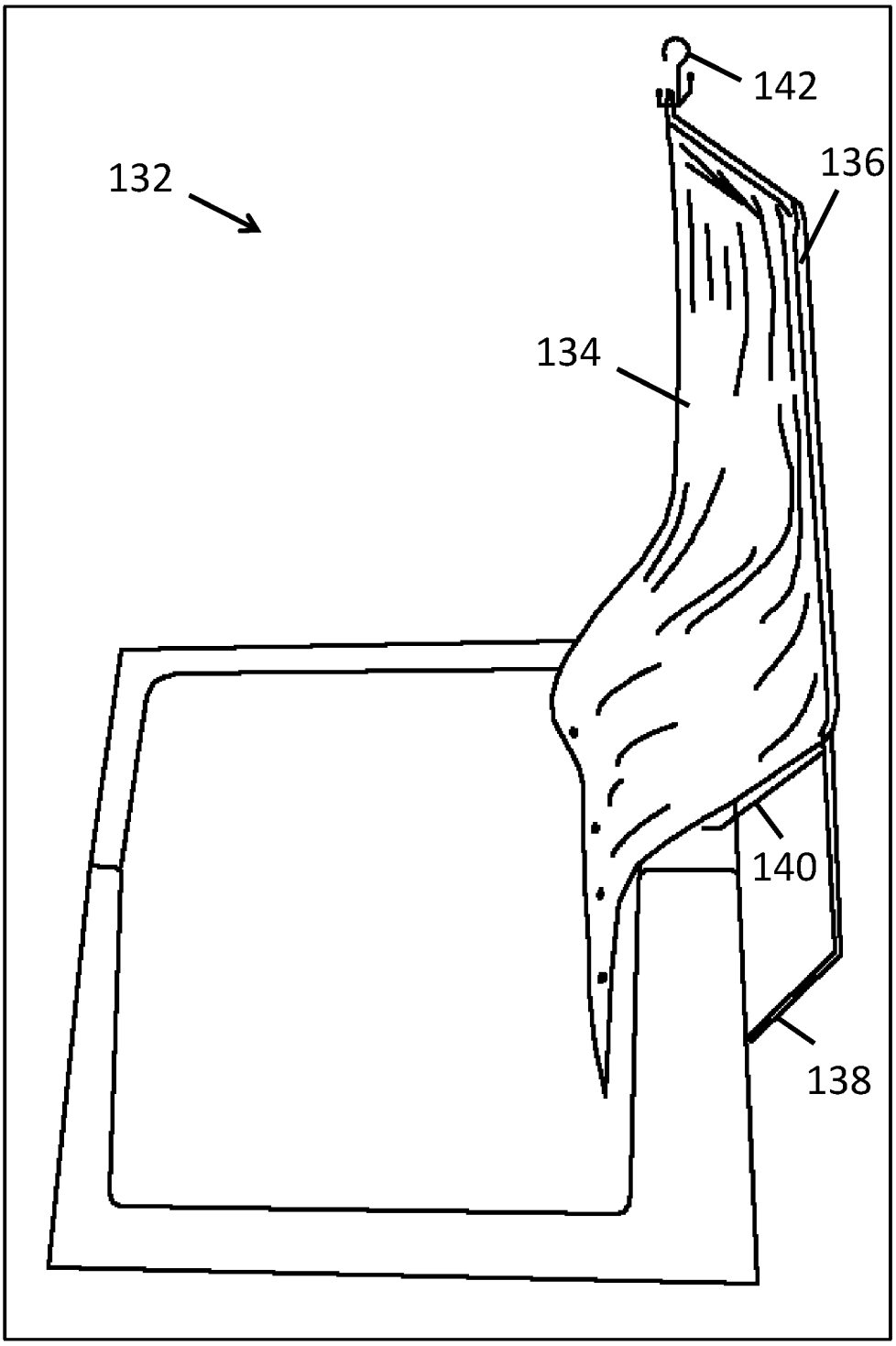
FIG. 10 is a side view of an implementation of a shower curtain liner assembly.

FIG. 10 shows an example of a shower curtain liner assembly (assembly) 132 which includes a liner 134 having sleeves 136, and rigid members 138 within the sleeves are used to hold the liner in the desired configuration. One or more liner guides 140 may be added onto (or included in/on) the rigid member. The liner guide is an angled rigid portion which angles downward and toward the tub/shower from the vertical portion of the rigid member (though, for rigid members of other shapes, it may simply be an angled rigid portion pointing generally downward and inward and somehow attached to or coupled with the rigid member). The function of the liner guide is to provide a backstop so that the liner is unlikely or unable to slide out of the inside of the shower tub and outside the tub—this preventing the spilling of water outside the shower. FIG. 10 also shows a hook member 142 which includes elements for hanging the liner and the shower curtain thereon and for hanging from a shower rod, similar to hook member 19 previously described.

The liner guide is optional, and in some implementations may be excluded. In implementations the liner guide does not touch the top of the tub but simply guides the liner. In some implementations it could alternatively rest on the top of the tub. In implementations the liner guide is about 3.5 inches, though in other implementations it could be longer or shorter. In implementations each rigid member has a liner guide, or only some of the rigid members, or none. The liner guide lays the liner in the right direction and deters it, in implementations, from slipping out of the tub, as discussed above. In implementations the liner guide will be sold with the other elements and the end user may attach the liner guides to the rigid members or not, as desired. In implementations the end user may select the height of the rigid member at which the liner guide attaches, to properly guide the liner into the tub. The liner guide may in implementations be especially useful if the liner is relatively shorter so that it may be more likely, without the liner guide, to slip out of the tub.

As indicated above, shower curtain liner assembly elements and related methods may provide rigid members in a type of framing or bracing system to prevent the shower curtain and liner from ever coming inward toward the interior of the shower and to also increase the size of the interior space of the shower for preference or for the purpose of accommodating larger users while still protecting the rest of the room from water leaking out the exterior of the shower tub.

Although in some implementations shower curtain liner assemblies are described herein as having a separate curtain and liner, in other implementations a single liner or single curtain (without the other) could be used, in either case it would drape inside the tub to keep water from exiting.

In some implementations of shower curtain liner assemblies the rigid members could go straight down from the top of the liner and sit on the outside of the tub's edge. This still creates more space and room (because it pulls the portion of the liner which is above the tub to be flush with the outer edge of the tub), and in such implementations the rigid members may have no angles, or may have no angles below a top first or second angle. In such implementations a user can position the shower rod closer towards, or directly above, the outer edge of the tub if desired, or it may be placed closer in towards the shower but with the rigid members still pulling the liner towards the outer edge of the tub. Even in implementations such as this wherein the shower rod is not flush with (but above) the outer edge of the tub, but is further inward towards the shower, the liner will still be pulled away from the user lower down where the user would be most likely to contact the liner, such as the shoulders or midsection of the user.

Figure 11:
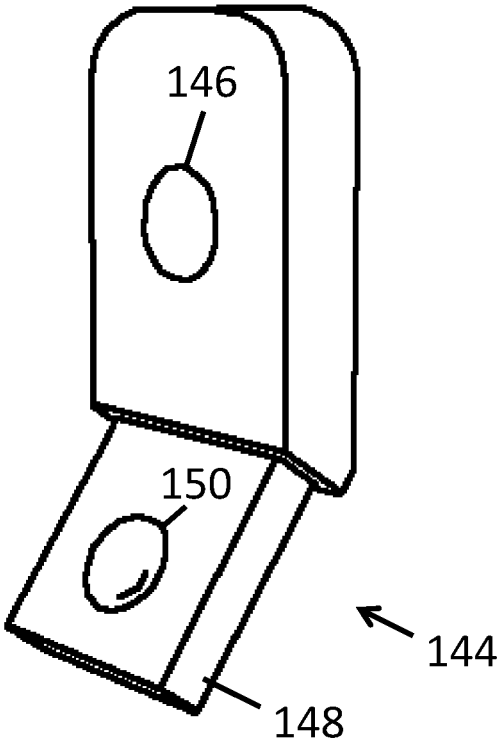
FIG. 11 is a perspective view of a top portion of an implementation of a rigid member.
Figure 12:
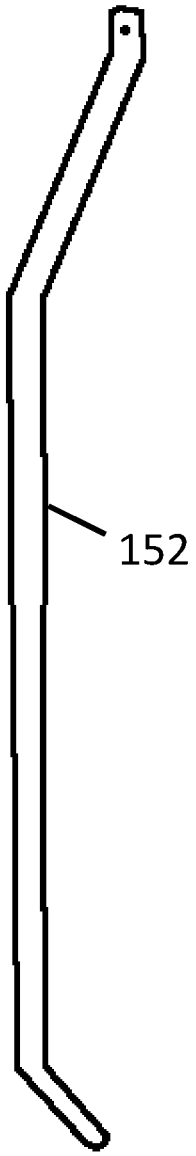
FIG. 12 is a perspective view of an implementation of a rigid member.
Figure 13:
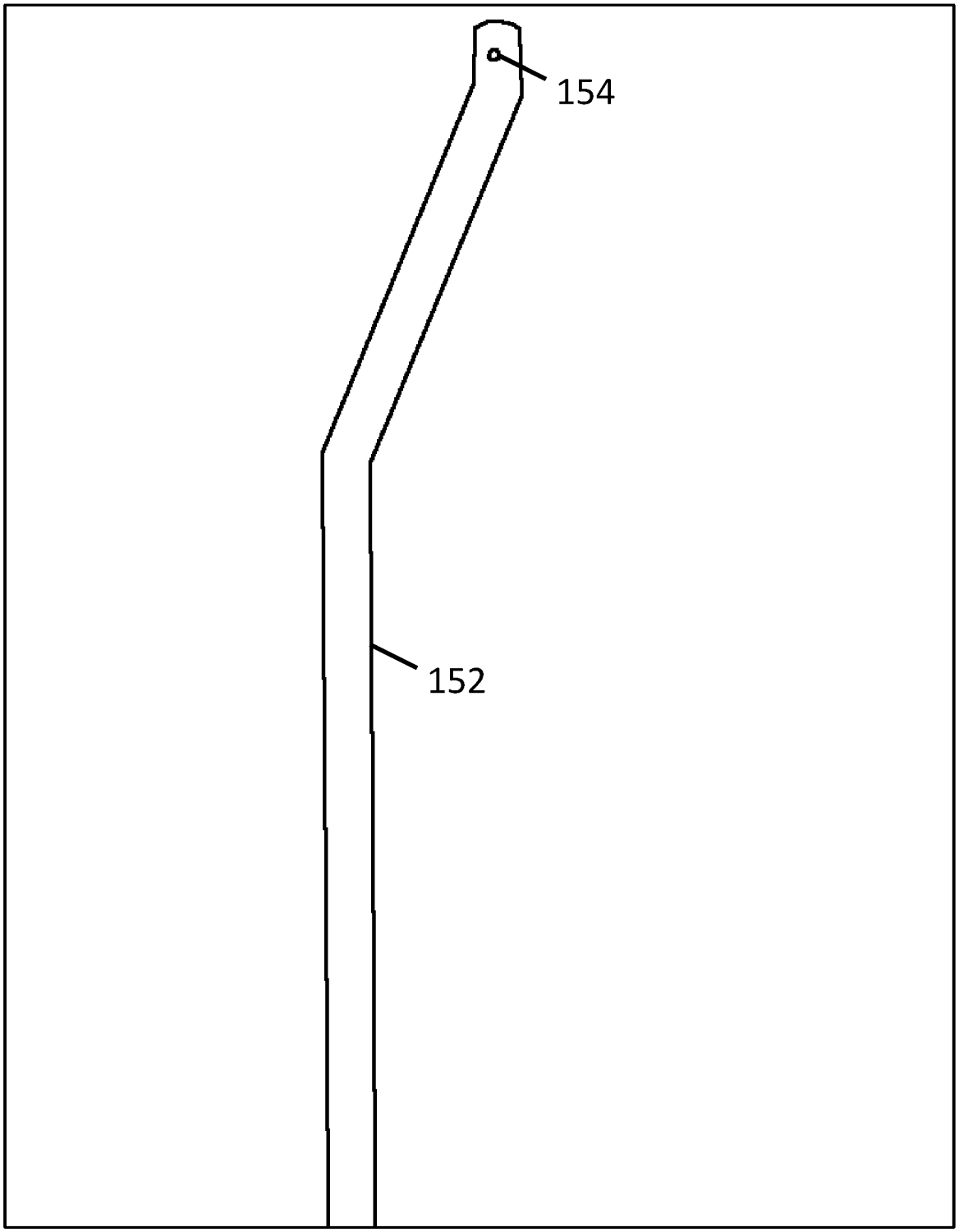
FIG. 13 is a perspective close-up view of the rigid member of FIG. 12.

FIGS. 11-13 show alternative examples of rigid members. In FIG. 11 only the top portion 144 of the rigid member is shown, and it may be seen that there is an opening 146 at the top to receive a hook, loop, or any other hanging mechanism to hang the rigid member (and accordingly shower curtain liner) to a shower curtain rod. There is also a coupler 150 in an angled portion 148 which may be used to couple the rest of the rigid member thereto. The coupler may be a pin or screw or the like to hold the rest of the rigid member thereon.

FIGS. 12-13 show perspective views of a rigid member 152, and FIG. 13 shows an opening 154 of the rigid member whereby it may be hung from a shower curtain or the like. Rigid member 152 could be a single solid piece of polymer or the like, though in other implementations it could be separate segments, such as including the top portion 144 and one or more other portions coupled together.

FIG. 14 shows a representative example of a shower curtain liner assembly 156 that has the rigid members permanently integrally formed in the liner 158 itself using thick portions 160 of the liner itself. In the example shown, the shower liner may be molded as one piece (such as out of a polymer that is flexible in the thin portions defining the shower curtain liner and rigid in the thick portions defining the rigid members). In other implementations the rigid members may be formed separately but may be permanently attached to the shower liner such as with a glue or adhesive, melting, heating, sonic welding, or the like. The top of each integrally formed or adhesively applied rigid member is seen to have an opening 162 for the receipt of hooks or loops for hanging the shower curtain liner assembly on a rod.

Figure 14A:
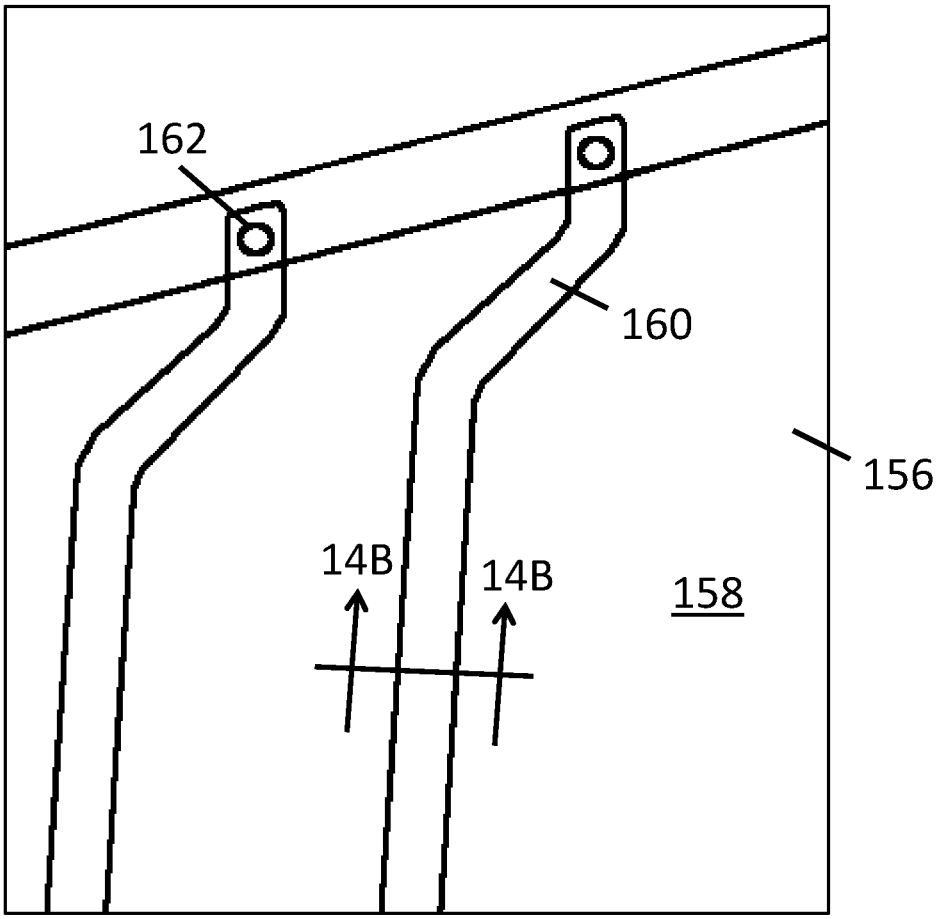
FIG. 14A is a perspective close-up view of an implementation of a shower curtain liner assembly.
Figure 14B:
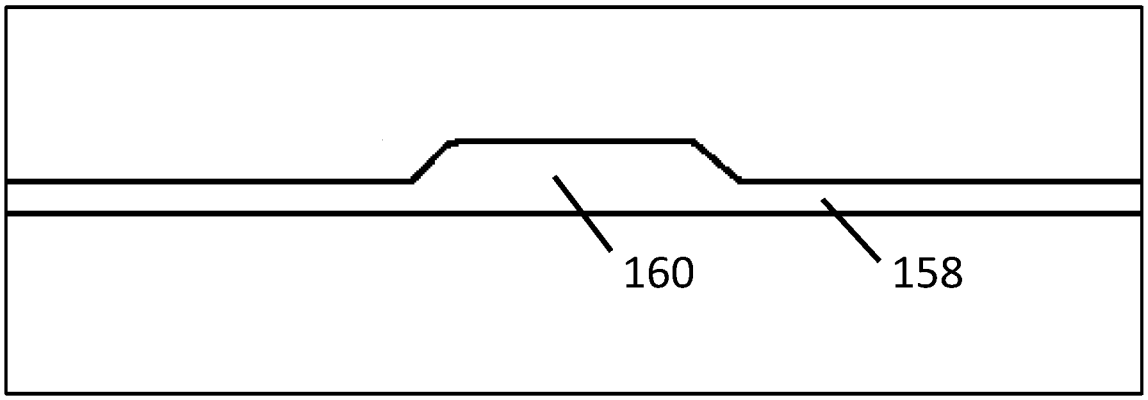
FIG. 14B is a cross section view of the shower curtain liner assembly of FIG. 14A.

FIG. 14B shows a cross section view of the liner of FIG. 14A (the cross section location called out in FIG. 14A) which illustrates an example of the thickness of the rigid member relative to the rest of the liner. FIG. 14B is not necessarily drawn to scale, but in implementations the thinner portions are thin enough to be flexible while the thicker portions are rigid so as to force the curtain liner outward away from the inside of the shower.

Figure 15:
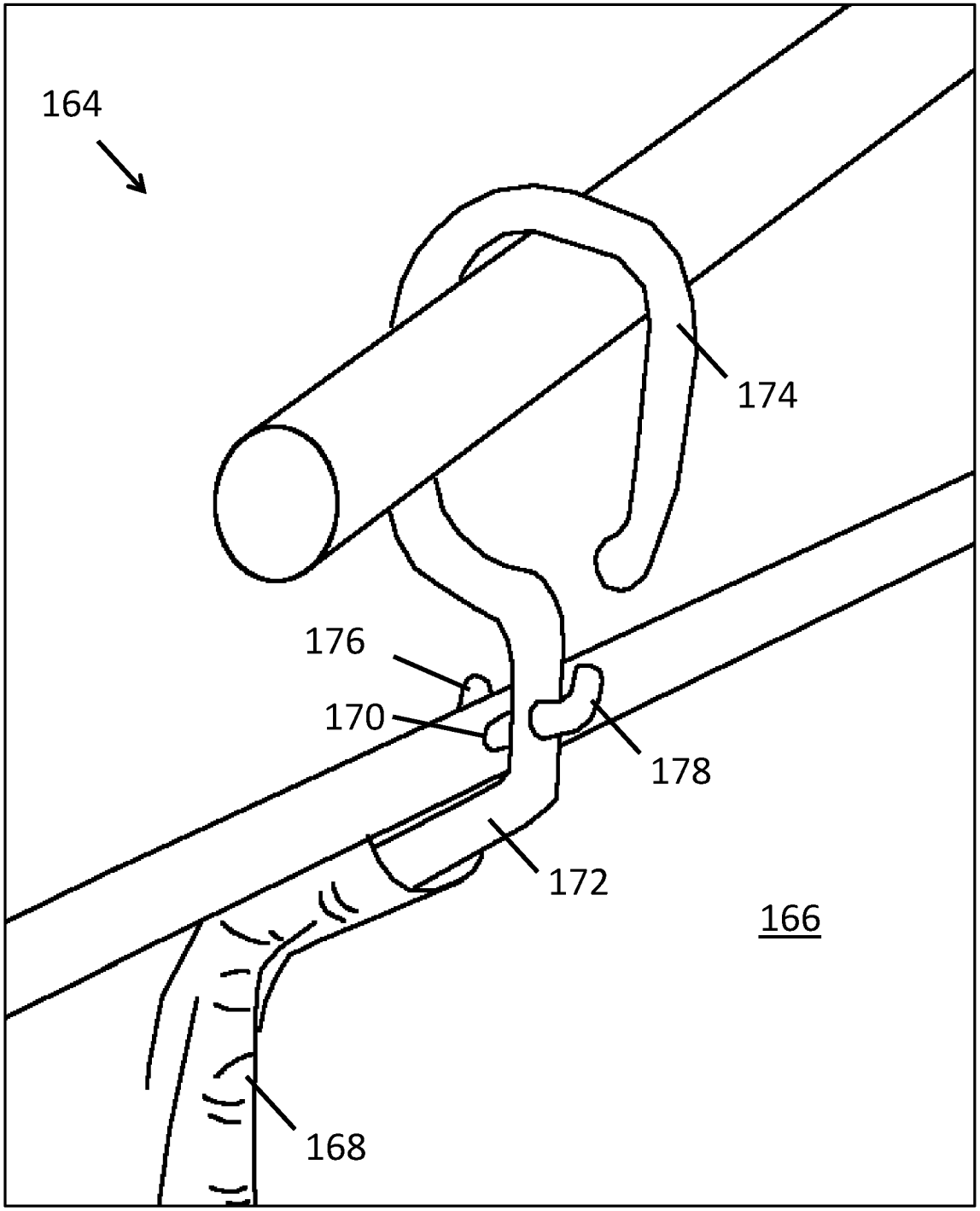
FIG. 15 is a perspective close-up view of an implementation of a shower curtain liner assembly.

FIG. 15 shows another implementation of a shower curtain liner assembly 164. In this implementation the liner 166 has a sleeve 168 for the rigid member 172 to be inserted into, as with other liners. The rigid member further has a first hook 176 and a second hook 178. One of the hooks is inserted into an opening 170 in the liner. The rigid member further has a loop 174 which loops around the shower curtain rod (also shown in FIG. 15) and which may be slid along the rod to expand and contract the liner. In implementations one of the hooks could be used to hang the liner and the opposite hook could be used to hang the shower curtain (in such implementations the liner would be on the opposite hook member than that on which it is hanging in FIG. 15, so that the curtain would be outside of the liner—and the sleeve may be on the reverse side of the liner or the liner may simply be turned around so that the sleeve faces into the page instead of out of the page). In the implementation of FIG. 15, though, the liner is shown hanging on the same hook from which the curtain would be hung, and so in some cases the liner and shower curtain could be hung on the same hook, with the curtain hanging outside the liner, i.e., hung from the hook after the liner is hung on the same hook so that it is the outermost element on the hook.

Figure 16:
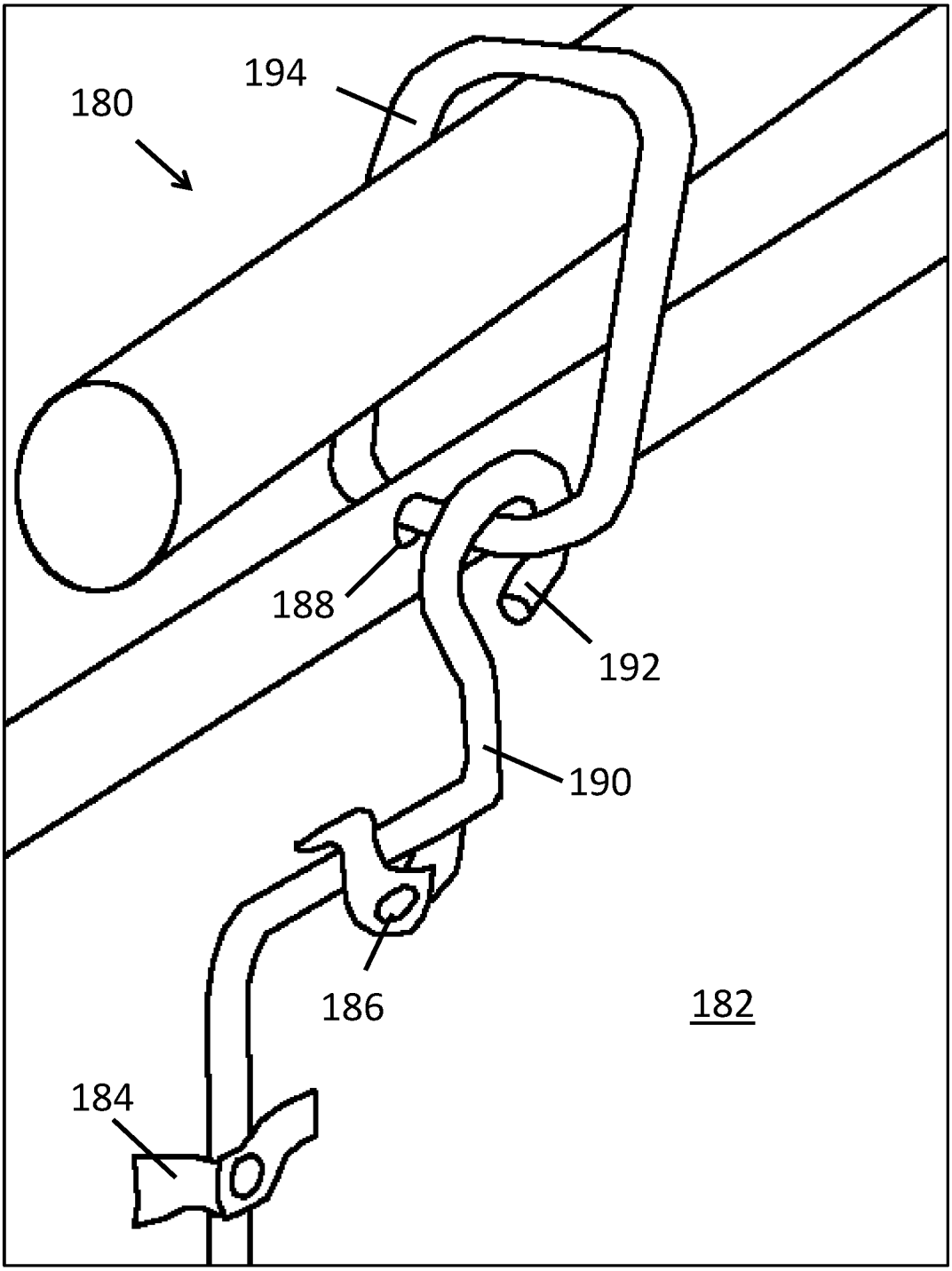
FIG. 16 is a perspective close-up view of an implementation of a shower curtain liner assembly.

FIG. 16 shows an implementation of a shower curtain liner assembly 180 in which the liner 182 includes flexible straps 184 that snap or button together such as with a snap 186 (in other implementations they could be magnetic closures or could use hook-and-loop fasteners) and the liner may be secured to the rigid member 190 using the closures. The rigid member has a hook or loop 192 that loops around a ring member 194. The top openings 188 of the liner also couple with the ring member, so that the rigid member and liner both hang from the ring member, which may slide along the shower rod (also shown in FIG. 16), while the rigid member positions a portion of the shower liner outwards away from the inside of the shower. The ring member need not be circular, indeed in FIG. 16 it is seen to have a rounded rectangular shape. The ring may have an opening or slit that allows it to be placed around the rod, in implementations, such as two ends of the ring that may snap in and out of closure with one another so as to be opened to be placed around the rod and then re-secured to be secure on the rod. Other mechanisms for opening the ring to be placed around the rod, and securing the ring in a closed configuration around the rod, may be used. In other implementations the ring may not have such a closure mechanism but may be slid around the rod after an end of the rod is removed or unscrewed, which end of the shower rod may be replaced to secure the ring members and prevent them from sliding off of the rod. In FIG. 16 the straps 184 are shown on the inside of the liner, facing towards the inside of the shower, but in other implementations the straps will be located on the outside of the liner, away from the shower, and the loop 192 will also be located on the outside of the liner, so that the straps, snaps, and loop are less likely to get wet during showering.

Figure 17A:
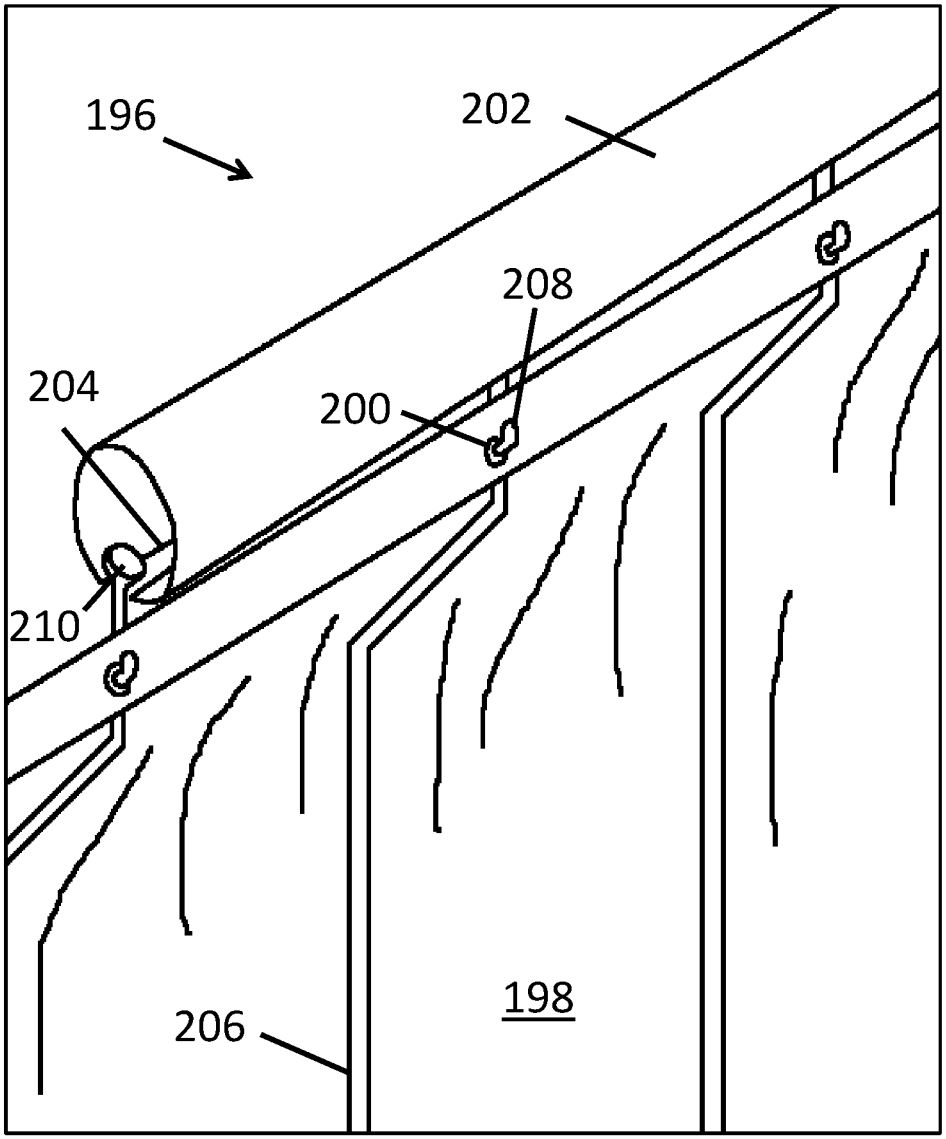
FIG. 17A is a perspective close-up view of an implementation of a shower curtain liner assembly.

FIG. 17A shows a shower curtain liner assembly 196 wherein the shower rod 202 itself is hollow and includes a thin slot 204 at the bottom. Each rigid member 206 in this instance has a thicker head 210 which is inserted into the inside of the rod and the narrow nature of the slot prevents the head from falling downwards, so that the rigid member hangs from the rod through the slot. Each rigid member then has a hook member (hook) 208 from which the liner 198 may be hung, using openings 200 of the liner, and the liner may be coupled with the rigid members or draped along them using any of the methods disclosed herein for other implementations. The shower curtain may be hung from the same hook members, or in implementations multiple hook members may be included on each rigid member, as discussed above for other implementations, so that the liner is hung from a first set of hook members and the curtain is hung from a second set of hook members. In the implementation of FIG. 17A the rigid members are in sleeves of the liner, though the sleeves are not shown, and the liner is shown as transparent, for ease of viewing the rigid members.

Figure 17B:
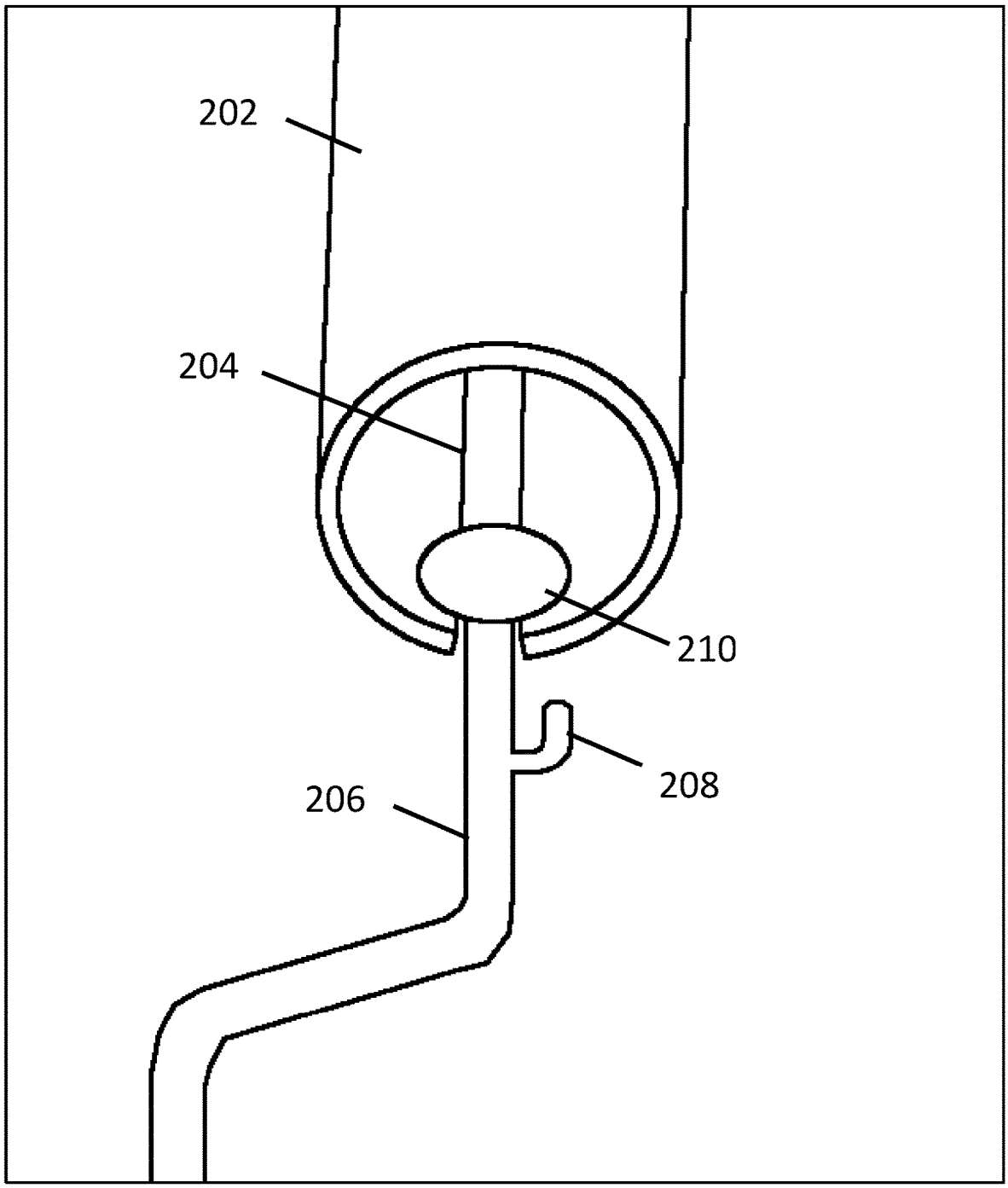
FIG. 17B is a side close-up view of a rod and rigid member of the shower curtain liner assembly of FIG. 17A.

FIG. 17B shows a side view of the shower rod 202 and a single rigid member of FIG. 17A, showing how the head 210 sits above the slot 204 to hang the rigid member 206 while a narrow neck of the rigid member below the head passes through the slot. The rigid members may naturally be slid back and forth in the slot to open and close the shower curtain and liner. The hook member 208 is also shown.

Figure 18:
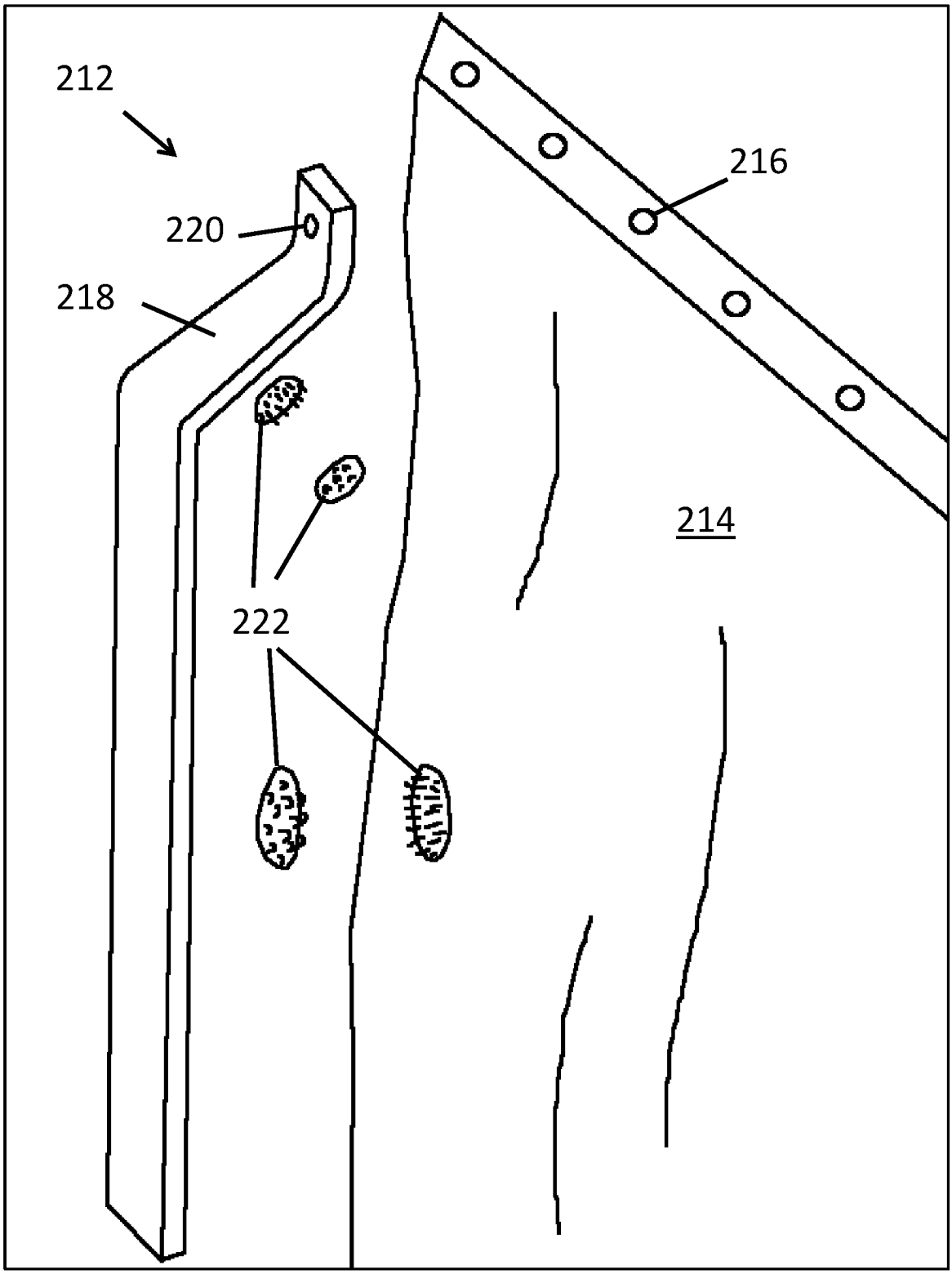
FIG. 18 is a perspective close-up view of an implementation of a shower curtain liner assembly.

FIG. 18 shows a shower curtain liner assembly 212 wherein an existing shower liner 214 (with existing openings 216 to receive hooks or loops to hang from a rod) may be modified by attaching hook-and-loop fasteners 222 to it using an adhesive. For example, strips, dots, squares, or other shapes may be used and, using an adhesive backing, may be attached to the liner along lines where the rigid members 218 will be placed. Opposite hook-and-loop fasteners 222 may be similarly adhered to the rigid member using an adhesive backing. For example the liner may receive the portions having hooks and the rigid member may receive the portions having loops, or vice versa or any other combination. As an alternative to hook-and-loop fasteners, double-sided tape could be used, or the rigid member could have magnetic members (or include a magnetizable metal) and magnet members with adhesive backing may be coupled with the liner (or magnetizable metal members coupled with the liner and magnets included or coupled with the rigid member). Such implementations allow the modification of an existing liner to be coupled with the rigid member. Multiple rigid members will be used but only one rigid member is shown in FIG. 18 (as with several of the other drawings) for ease of viewing the elements. The rigid member of FIG. 18 is seen to have an opening 220 which will align with one of the openings 216 for coupling with the shower rod using the same loop or hook or other element that couples the liner with the rod.

Figure 19:
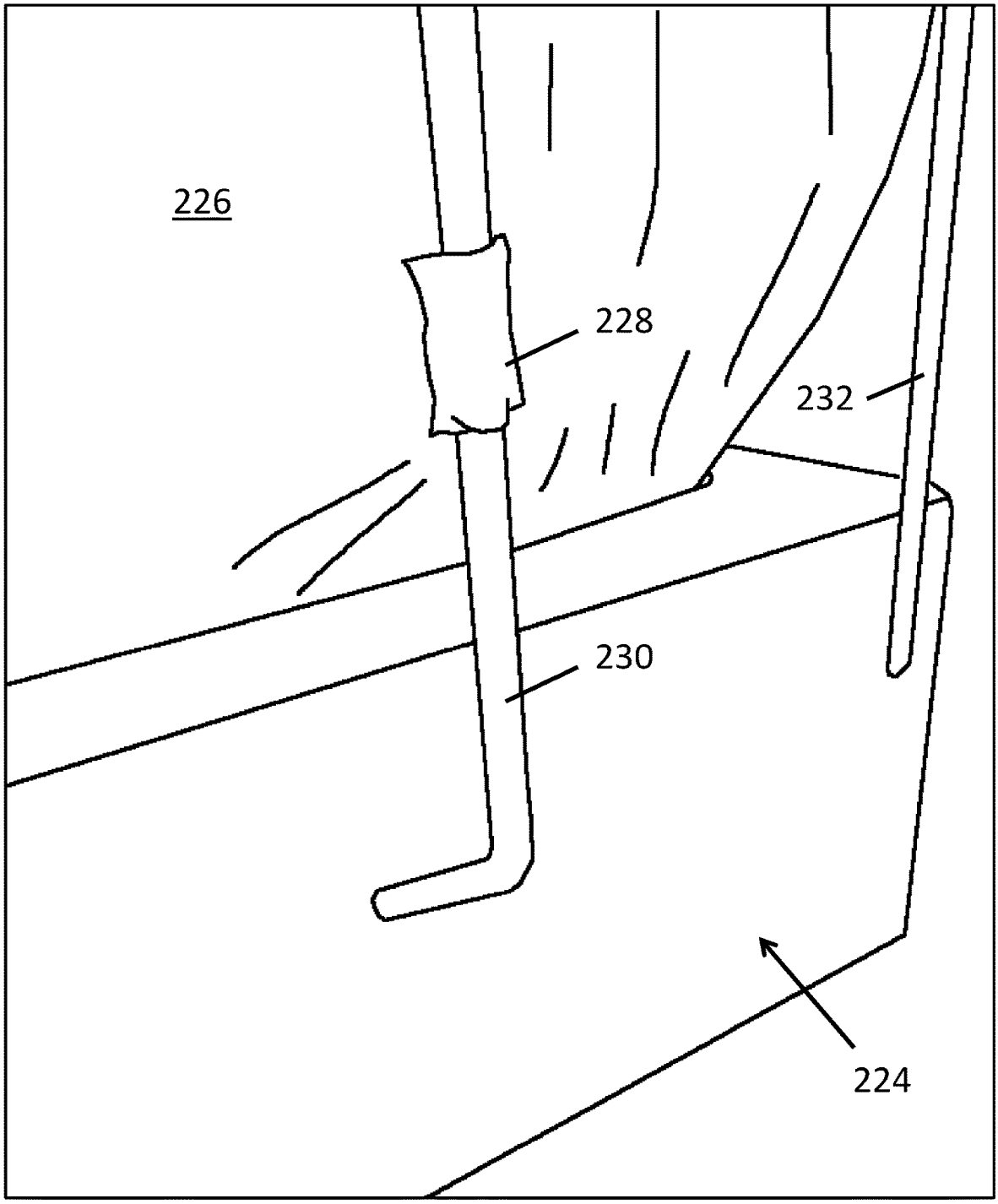
FIG. 19 is a lower outside perspective view of an implementation of a shower curtain liner assembly.

Referring now to FIG. 19, a shower curtain liner assembly (assembly) 224 is shown which includes a liner 226 having sleeves 228 for receiving rigid members 230 and 232. Liner 226 has additional sleeves not shown in FIG. 19 as it is a close-up view of the bottom portion of assembly 224. Rigid member 230 is seen to have a curved portion towards the bottom so that the lowermost portion of the rigid member 230 is angled towards the tub. This allows the vertical portion of the rigid member to be positioned a distance from the tub. In the implementation shown the rigid member could be originally molded having the curved portion, though in implementations the rigid member could be originally formed of a straight member such as a polyvinyl chloride (PVC) pipe which is bent using a heated bending step. In this step the PVC pipe is filled with sand then heated with a heat gun and bent, then the sand is removed once the PVC has cooled some. While the heating is being done and while the PVC is cooling the sand helps to prevent the hollow portion from collapsing. The rigid member 232 is seen to be vertical and to not have a curved portion at its bottom, but to simply abut the tub. In some implementations of shower curtain liner assemblies it may be useful to have the rigid members at the distal ends have no curved portions, as in FIG. 19, but to have all rigid members between the two distal ends have curved portions. This may be useful because it may be useful to have the central rigid members pull the liner further out, as a user is normally standing somewhere near the center of the tub/shower when showering, whereas it may not be necessary to pull the liner as far away from the interior of the shower at the distal ends where the user normally is not standing. Additionally, allowing the liner to not be pulled as far away from the interior of the shower at the distal ends may ensure that the liner at the distal ends is situated in a better position to prevent water from escaping the shower.

Figure 20:
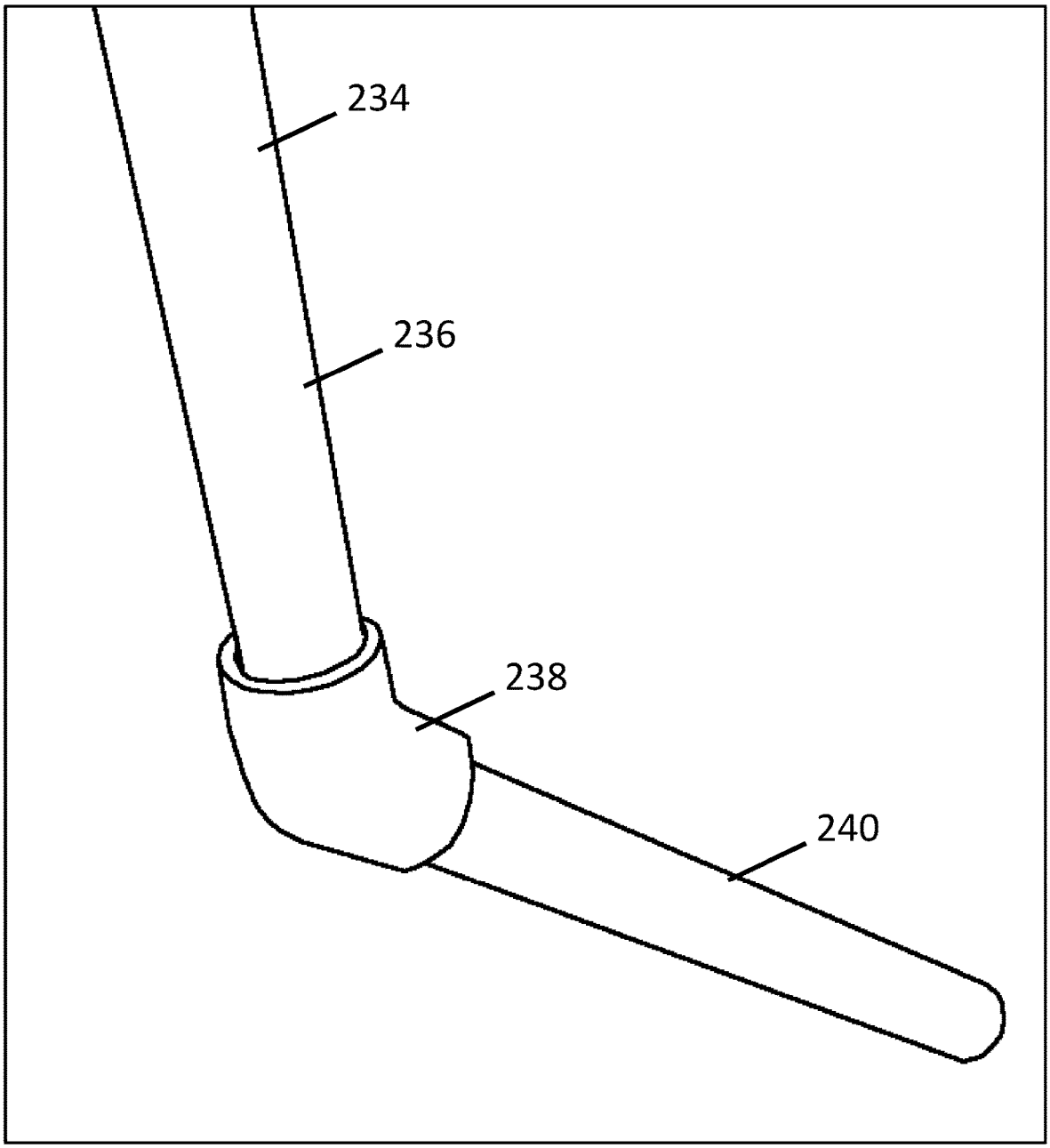
FIG. 20 is a perspective view of an implementation of a rigid member.

FIG. 20 shows an alternative example of a rigid member with a curved/angled portion at the bottom. In this example the rigid member 234 includes a first portion 236, which is a straight member, which is coupled with another straight member, second portion 240, using an elbow joint 238. One example could be two straight PVC pipes coupled together using a PVC elbow joint, though the first portion, second portion, and elbow joint could be formed of other materials. Elbow joints having other angles could be used, as well, and the first portion and second portion could have other relative dimensions and lengths than those shown in FIG. 20.

Figure 21:
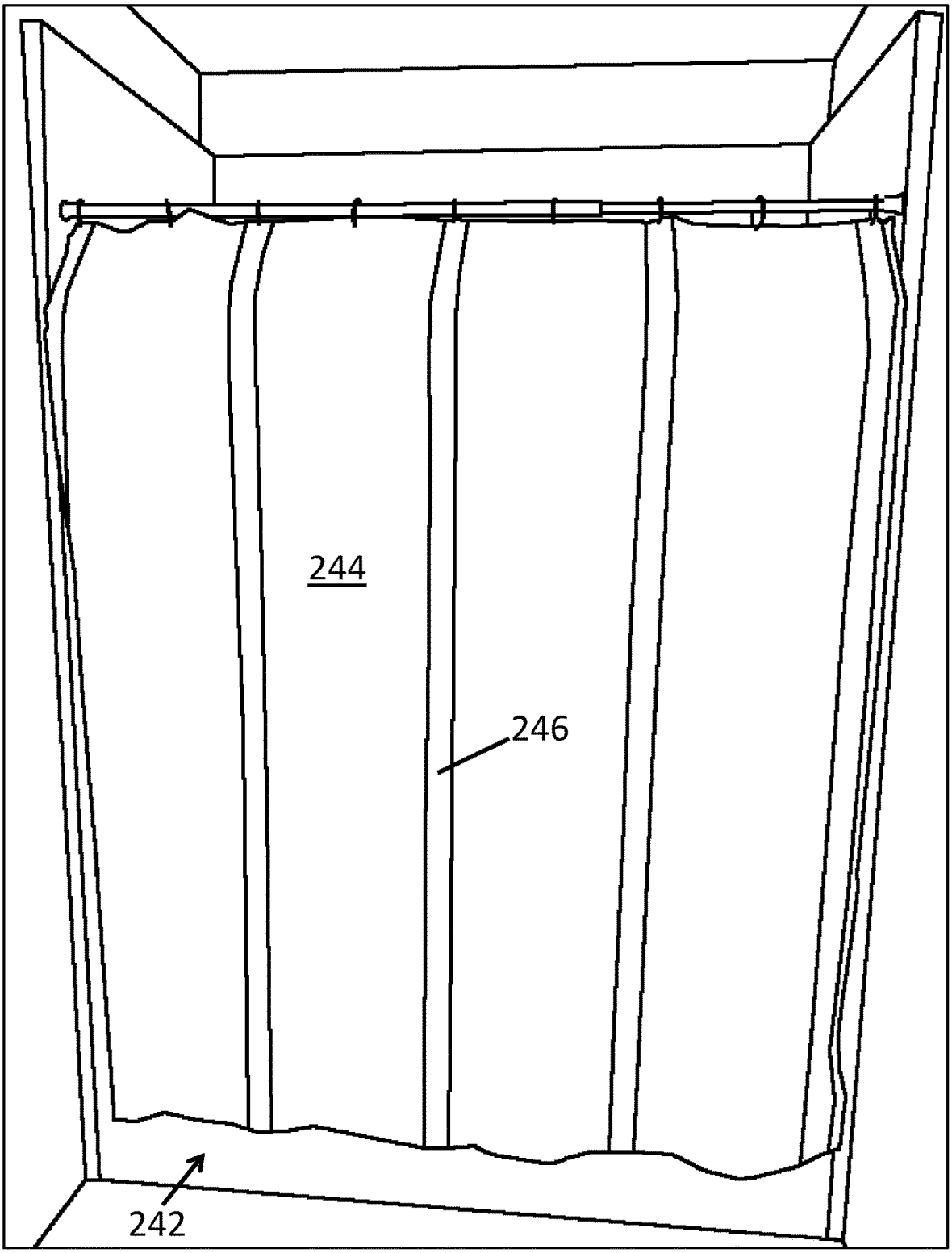
FIG. 21 is an outside perspective view of an implementation of a shower curtain liner assembly in a fully expanded configuration.
Figure 22:
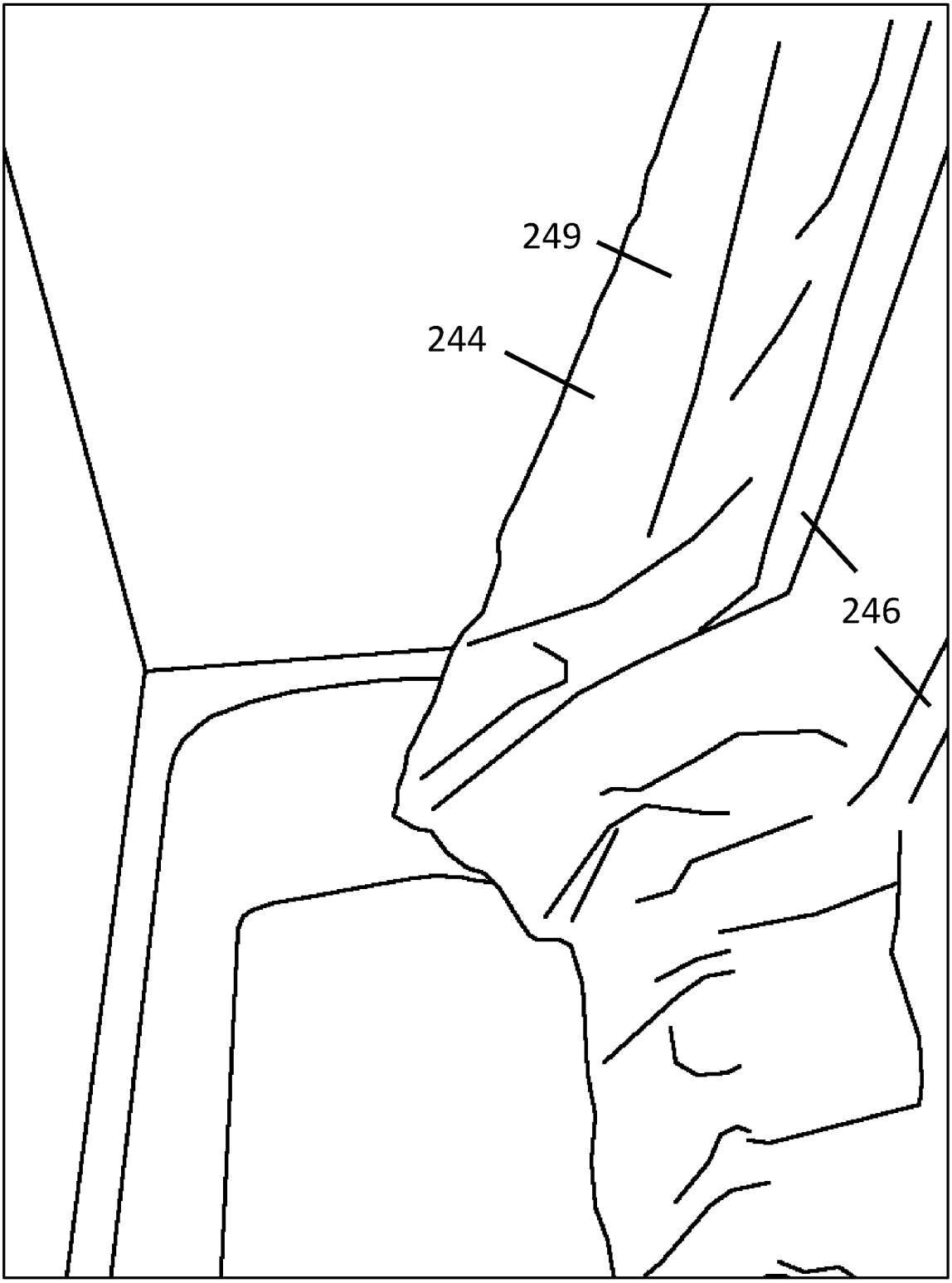
FIG. 22 is a lower inside perspective view of an implementation of a shower curtain liner assembly.
Figure 23:
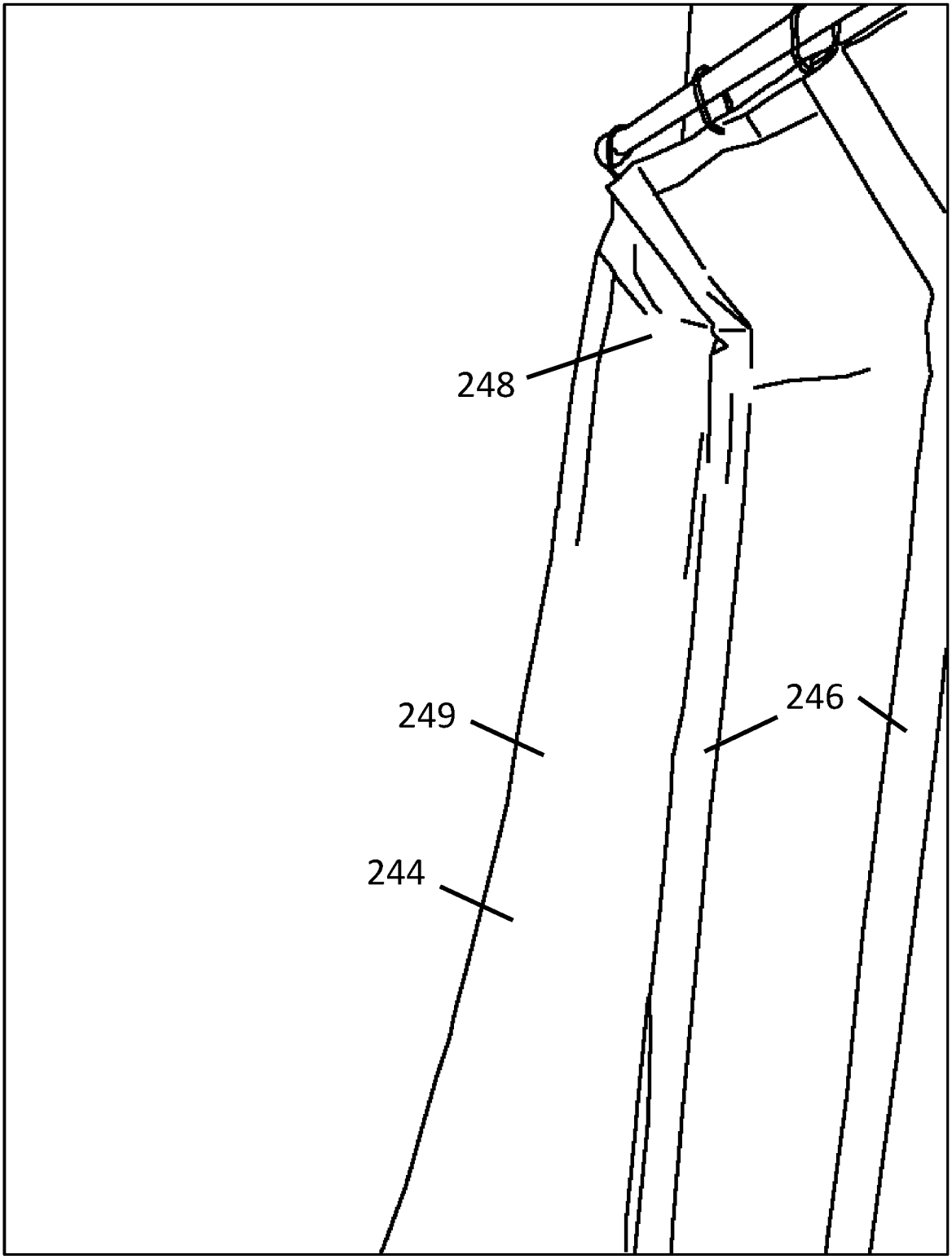
FIG. 23 is an upper inside perspective view of an implementation of a shower curtain liner assembly.

FIG. 21 shows an example of a shower curtain liner assembly 242 in a fully expanded configuration. The outer curtain is not shown in FIG. 21 and, although the liner 244 is normally situated inside the tub, it is draped here outside the tub just to show the full vertical height of the liner. The liner is seen to have sleeves 246 which receive the rigid members (not shown). The liner is seen hanging from a shower curtain rod with the use of common shower curtain rod rings. FIG. 22 shows a lower inside view of liner 244 from inside the tub once the liner has been draped inside the tub. The liner is seen to be, generally, pushed outward from the inside of the shower so that there is more room within the shower. A couple of the sleeves 246 are also shown. FIG. 23 shows an upper perspective view of the liner 244 which again shows a couple of the sleeves 246 and, additionally, shows a corner portion 248 where the liner makes an about 90-degree angle with itself. This facilitates the formation of a side panel 249 which helps to prevent water from exiting the shower during use. This is similar to the configuration shown in the liners of FIGS. 7A-8, and in implementations the 90-degree or about 90-degree configuration of the corner of the liner relative to the rest of the liner helps to ensure that the liner is situated properly to prevent water from escaping the shower by helping to form the side panels. The terms "about 90-degrees" and "about 90-degree angle" or "about 90-degree configuration" as used herein are defined as angles between (and including) 75 degrees to 115 degrees. The liners of FIGS. 7A-8 also include similar corner portions and side panels to prevent water from exiting the shower.

Figure 24:
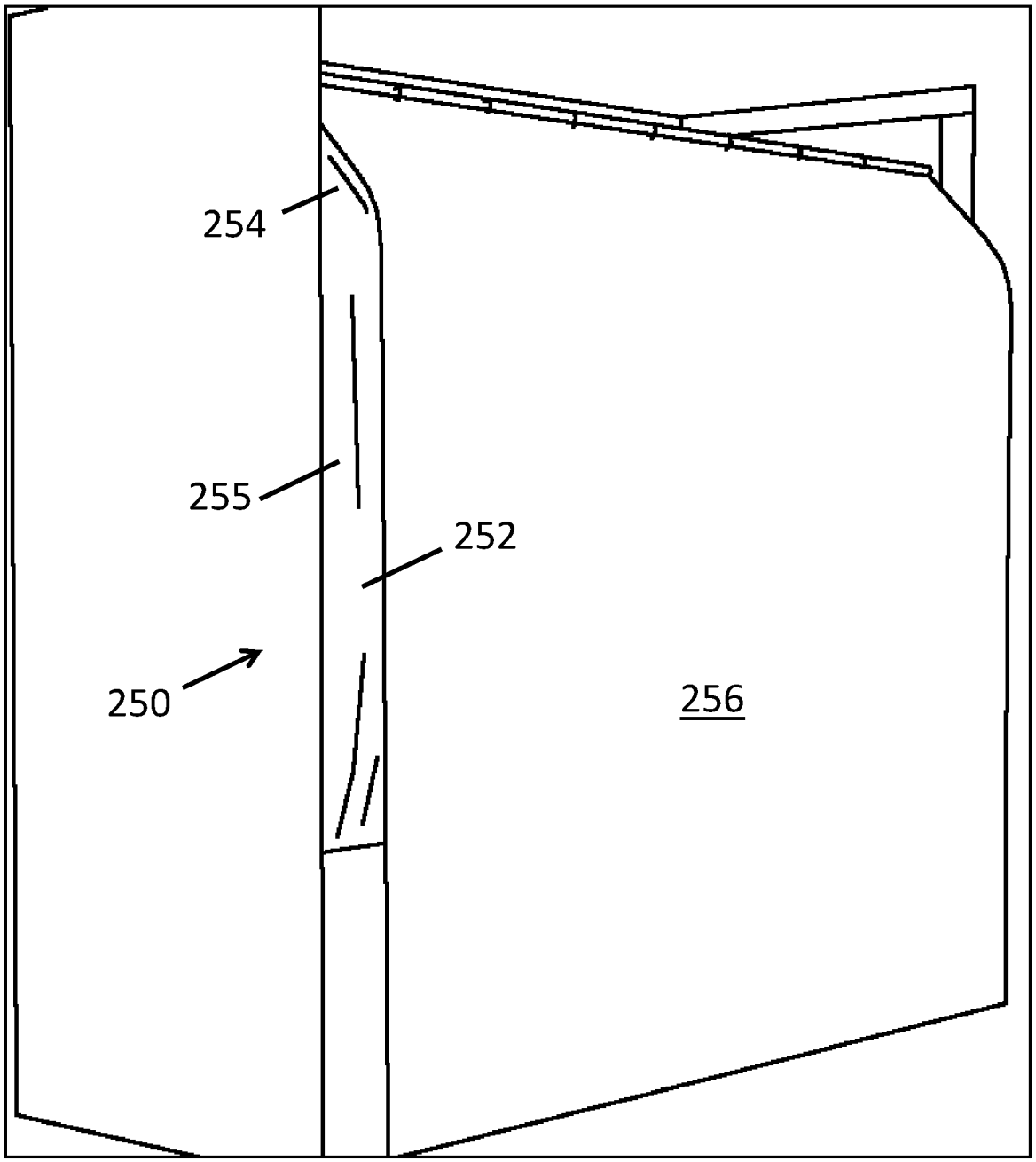
FIG. 24 is an outside perspective view of an implementation of a shower curtain liner assembly in a fully expanded configuration.

FIG. 24 shows a shower curtain liner assembly 250 which includes a shower curtain 256 and a liner 252 having corner portions 254 and side panels 255 similar to the corner portions and side panels of FIG. 23 (although only one corner portion and side panel is shown in FIG. 24, they exist on both distal ends of the liner). The curtain and liner are seen to be in fully extended configurations. The curtain in fact is seen to be in a taut configuration, and in some implementations, as discussed above, the taut expanded configuration of the assembly situates the rigid members in desirable positions for use of the assembly during showering.

In implementations the liners of FIGS. 21-24 may have a horizontal width at the topmost edge of 56 inches or about 56 inches, 57 inches or about 57 inches, 58 inches or about 58 inches, or 59 inches or about 59 inches. The term "about" used in connection with these dimensions is meant to include a range of +/−1 inch.

Figure 25:
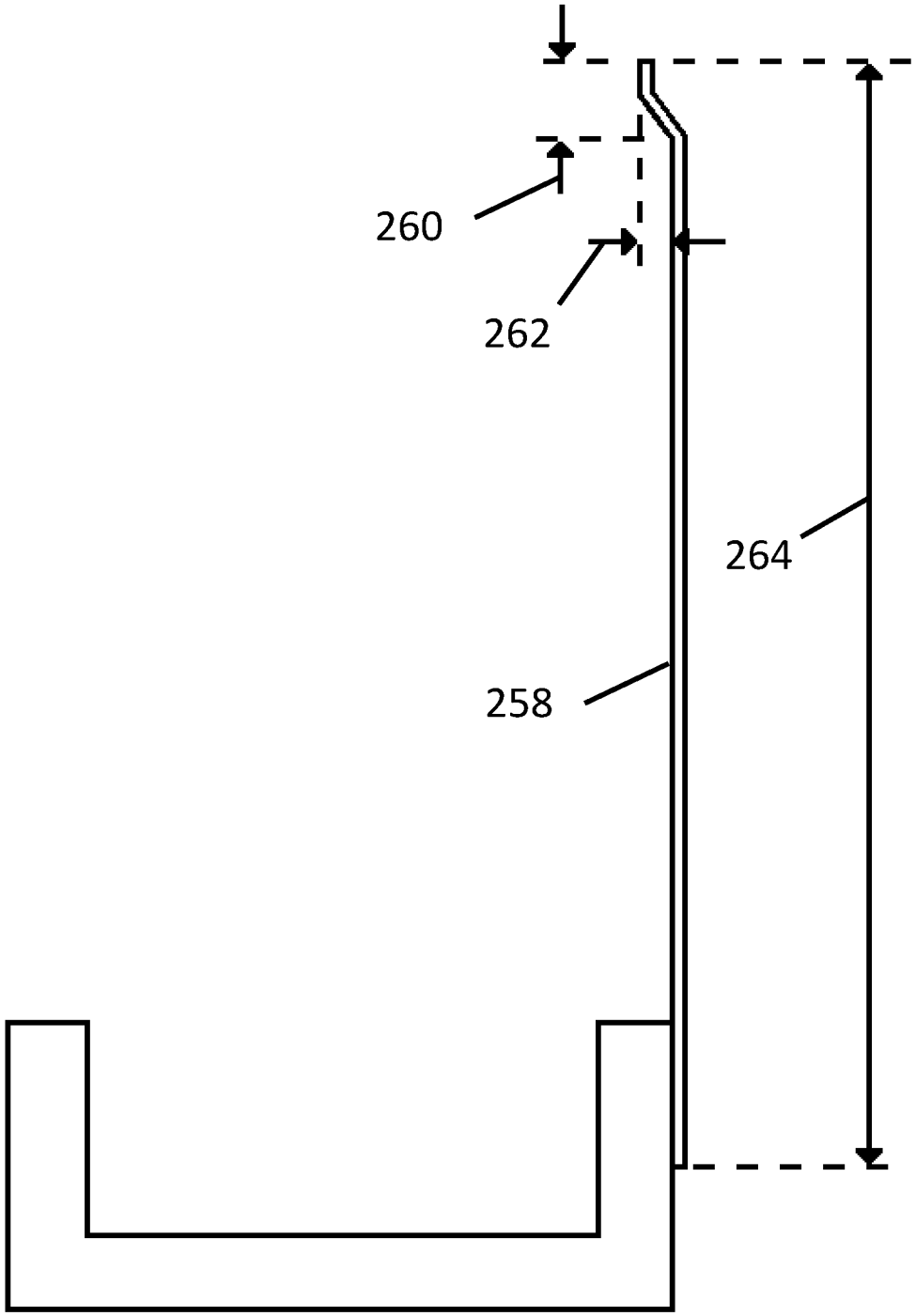
FIG. 25 is a side view of an implementation of a rigid member resting against a tub.
Figure 26:
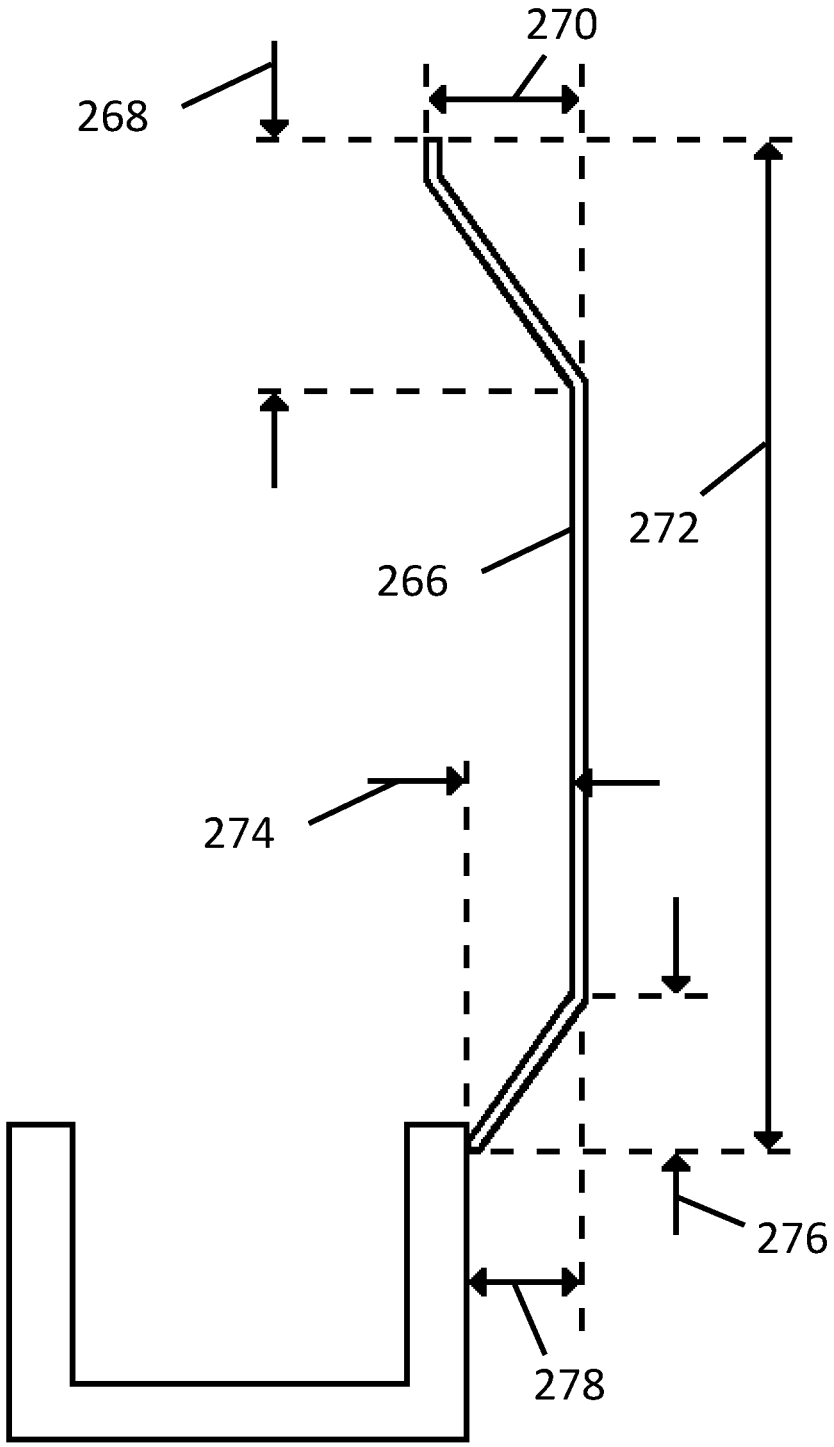
FIG. 26 is a side view of an implementation of a rigid member resting against a tub.
Figure 27:
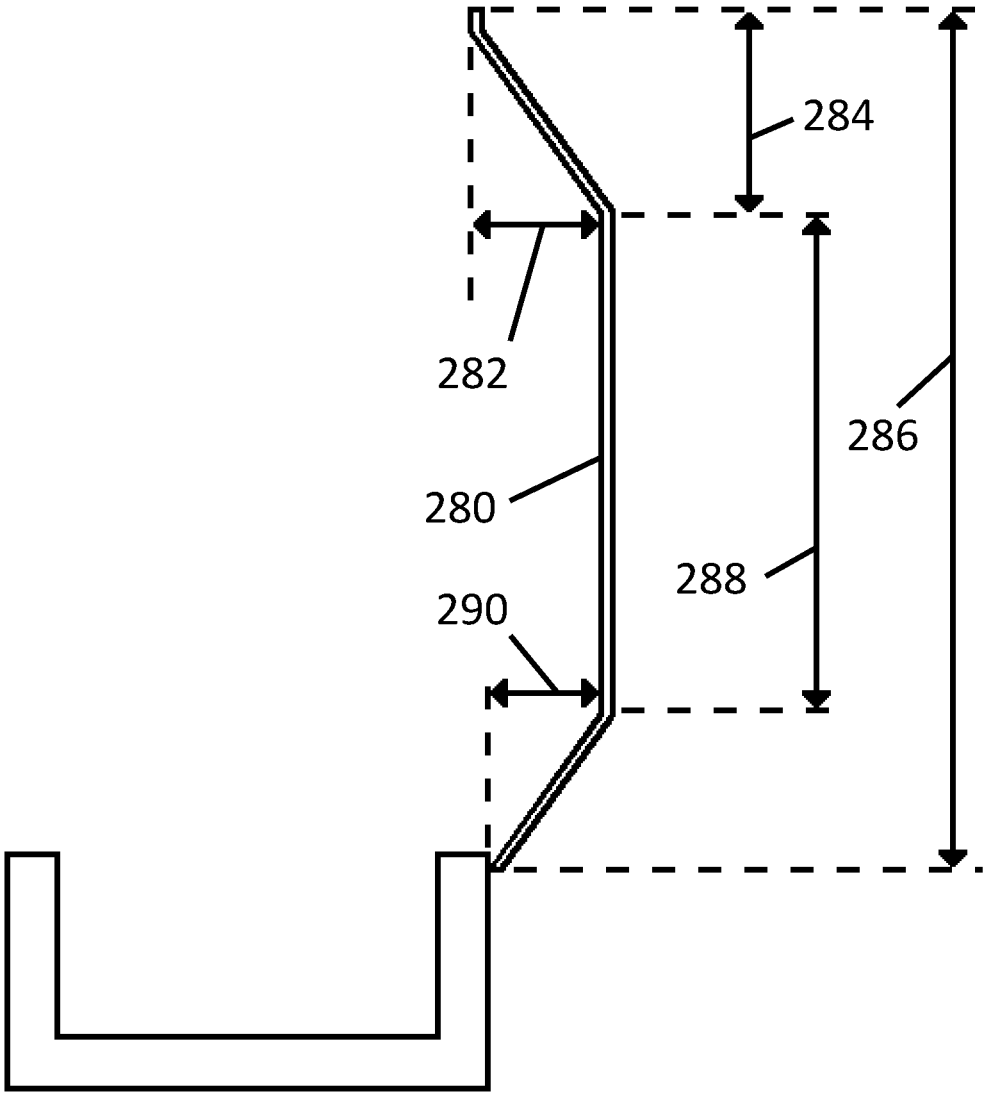
FIG. 27 is a side view of an implementation of a rigid member resting against a tub.

There are a variety of rigid member shapes and sizes that could be used in different shower curtain liner assemblies, and some examples are shown in FIGS. 25-27, which are not drawn to scale but which are shown resting against a tub in each case. In FIG. 25 rigid member 258 is seen to have a dimension 260 of 2.65 inches, a dimension 262 of 1.11 inches, and a dimension 264 of 61.74 inches. In implementations this assembly adds 6 inches of space, or about 6 inches of space, to the interior of the shower, assuming a tub sidewall of about 5 inches and assuming a prior art shower curtain liner normally resides about 1.5 inches inward (towards the center of the tub) from the inner sidewall of the tub.

In FIG. 26 rigid member 266 has a dimension 268 of 6.65 inches, a dimension 270 of 4.12 inches, a dimension 272 of 61.74 inches, a dimension 274 of 2.79 inches, a dimension 276 of 4.06 inches, and a dimension 278 of 3.04 inches. In implementations this assembly adds 9 inches of space, or about 9 inches of space, to the interior of the shower, assuming a tub sidewall of about 5 inches and assuming a prior art shower curtain liner normally resides about 1.5 inches inward (towards the center of the tub) from the inner sidewall of the tub.

In FIG. 27 rigid member 280 is seen to have a dimension 282 of 6.86 inches, a dimension 284 of 10.79 inches, a dimension 286 of 61.74 inches, a dimension 288 of 47.44 inches, and a dimension 290 of 5.75 inches. In implementations this assembly adds 12 inches of space, or about 12 inches of space, to the interior of the shower, assuming a tub sidewall of about 5 inches and assuming a prior art shower curtain liner normally resides about 1.5 inches inward (towards the center of the tub) from the inner sidewall of the tub.

Each of the rigid members of FIGS. 25-27 includes a hole/opening in the topmost vertical portion to receive a hook which then loops around and/or hangs on the shower rod. In implementations, each of the topmost vertical elements is positioned horizontally one inch in from the outermost edge of the tub (the edge which the bottom of the rigid member abuts) so that the rigid member can hang from the shower curtain rod which is positioned at that location. Each of the rigid members of FIGS. 25-27 is shown having a bottom that abuts the tub but, in implementations, the bottommost end of the rigid member could be situated above the top of the tub and still provide additional space in the shower (though in such implementations the bottom of the rigid member may be rotated inward some towards the inside of the tub, so that not as much space may be provided towards the bottom of the tub). The liners and curtains are not shown in FIGS. 25-27, for ease of viewing the other elements.

Implementations of liners used with the rigid members of FIGS. 25-27 may or may not have the corner portions and side panels, as described above with respect to some liners. In implementations the six inch version (of FIG. 25) may function well with a liner that does not have the corner portions and side panels but which nevertheless has sleeves or another mechanism for coupling with the rigid members. With the larger rigid members (nine inch and twelve inch versions) the liner may benefit from the corner portions and side panels to prevent water from escaping the shower during use.

Figure 28:
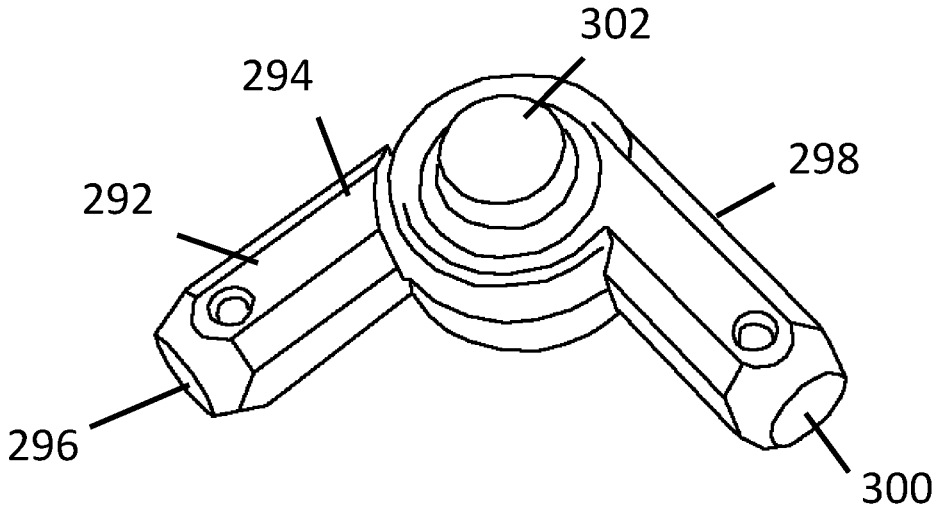
FIG. 28 is a perspective view of an implementation of a connector.

FIG. 28 shows an example of a connector that could be used to connect two portions of a rigid member. Connector 292 includes a first end 294 having an opening 294 and a second end 298 having an opening 300. The first end and second end are coupled with one another in a fashion whereby they may rotate relative to one another. A button 302 may be depressed to allow the two ends to rotate relative to one another, while letting go of the button may lock the two ends at the configuration they are then in. In implementations the two ends may be rotated to innumerable positions within a given range (for example between 60 degrees and 180 degrees) while, in other configurations, the device may have a discrete number of positions (for example every 5 degrees between and including 60 degrees and 180 degrees) that are facilitated by a pin and hole mechanism or the like. Rigid member portions could be slid into the openings 296 and 300 such as in a friction fit or adhesively secured therein or secured with a screw such as through the shown screw hole or, alternatively, hollow rigid member portions could be slid over the first end and second end, such as in a friction fit or adhesively secured thereto or secured with a screw such as through the shown screw hole. The implementation of FIG. 28 is formed of a polymer but in implementations it could also be formed of a metal or other material.

Figure 29:
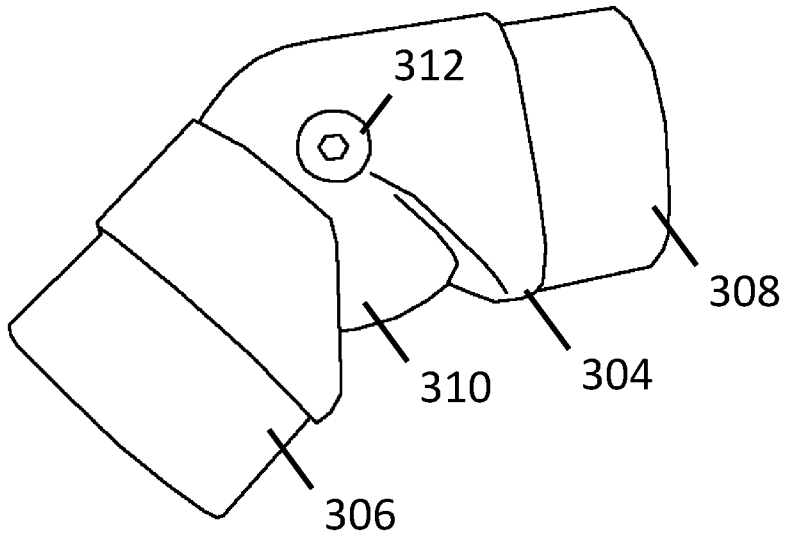
FIG. 29 is a perspective view of an implementation of a connector.

FIG. 29 shows another connector 304 that could be used to connect rigid member portions/sections in a rotating configuration. Connector 304 has a first end 306 and second end 308 coupled with a ball joint 310 which may be secured to a non-rotating configuration using tightener 312 which, in this implementation, is a hex bolt. In other implementations a screw or the like could be used instead of a hex bolt. The first and second ends may be hollow and the rigid member sections could be placed therein, or hollow rigid members could be placed around the first and second ends. The ball joint allows the two sections of the rigid members to be rotated to innumerable positions within a range (such as, for example, between 60 degrees and 180 degrees). As with the above connector 292, connector 304 allows for the formation of angles/angled portions of implementations the rigid member so that each section may be straight but so that there may still be angled portions of the rigid members to facilitate the holding of the shower liner away from the inside of the shower. The implementation of FIG. 29 is formed of metal, but in other implementations the entire device could be a polymer (such as PVC) and as indicated could be tightened using a flathead (slot) or PHILLIPS screw. In some implementations the ball joint may be tightened to a point where the joint may still be rotated but, once manually rotated to a certain position, it tends to stay in that position. In such a configuration the friction of the ball joint may be overcome by manual force alone to rotate the first and second end but, once rotated, they tend to stay in that configuration until again manually rotated.

Figure 30:
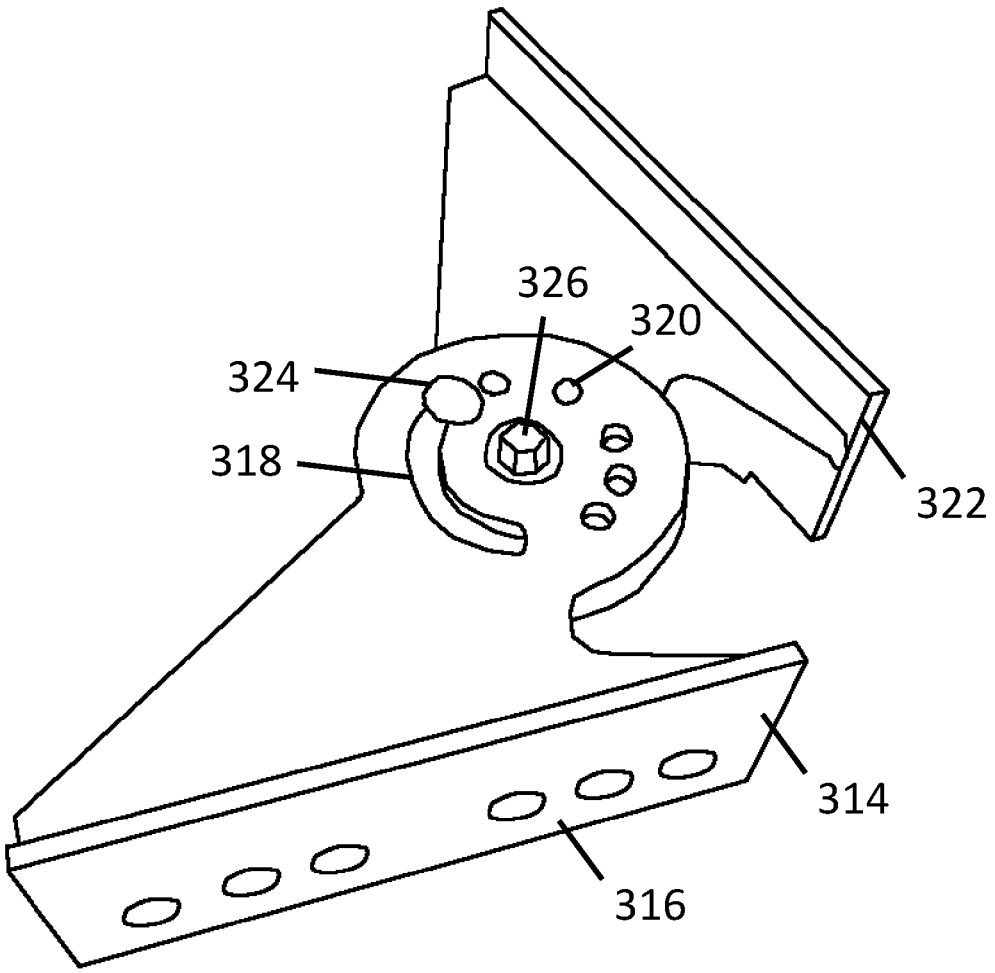
FIG. 30 is a perspective view of an implementation of a connector.

FIG. 30 shows another implementation of a connector 314. Connector 314 includes a first member 316 and second member 322 rotatingly coupled with one another. The first member is seen to be secured to the second member using tightener/screw 326. Tightener 326 could be a bolt, screw, etc. Retainer 324 is inserted into the slot 318 and is secured to the second member so that the first member may rotate only between certain angle ranges as determined by the retainer and slot. A number of openings 320 are shown in the first member, and the second member may have a corresponding pin or pins (not shown) that are biased upwards towards the openings and tend to secure the first and second members in discrete positions relative to one another (for example only every 5 or 10 degrees between and including the maximum and minimum angles of rotation as determined by the retainer and slot). The first member and second member may be secured to rigid members, for example the first member is seen to have a number of holes on its rectangular flat surface and a rectangular section of a rigid member could be secured thereto. Alternatively, the rectangular flat surface could be a semicylindrical surface to receive a cylindrical section of a rigid member. The connector 314 is formed of a polymer but, in other implementations, could be formed of metal or another material.

Other connectors may include a first end and second end that rotate relative to one another to discrete positions using "clickable" rotating elements that slide relative to one another with raised portions on one side/element and depressions on the other side/element, which may be tightened using a wingnut or the like to prevent rotation once a desired rotation is reached.

Figure 31:
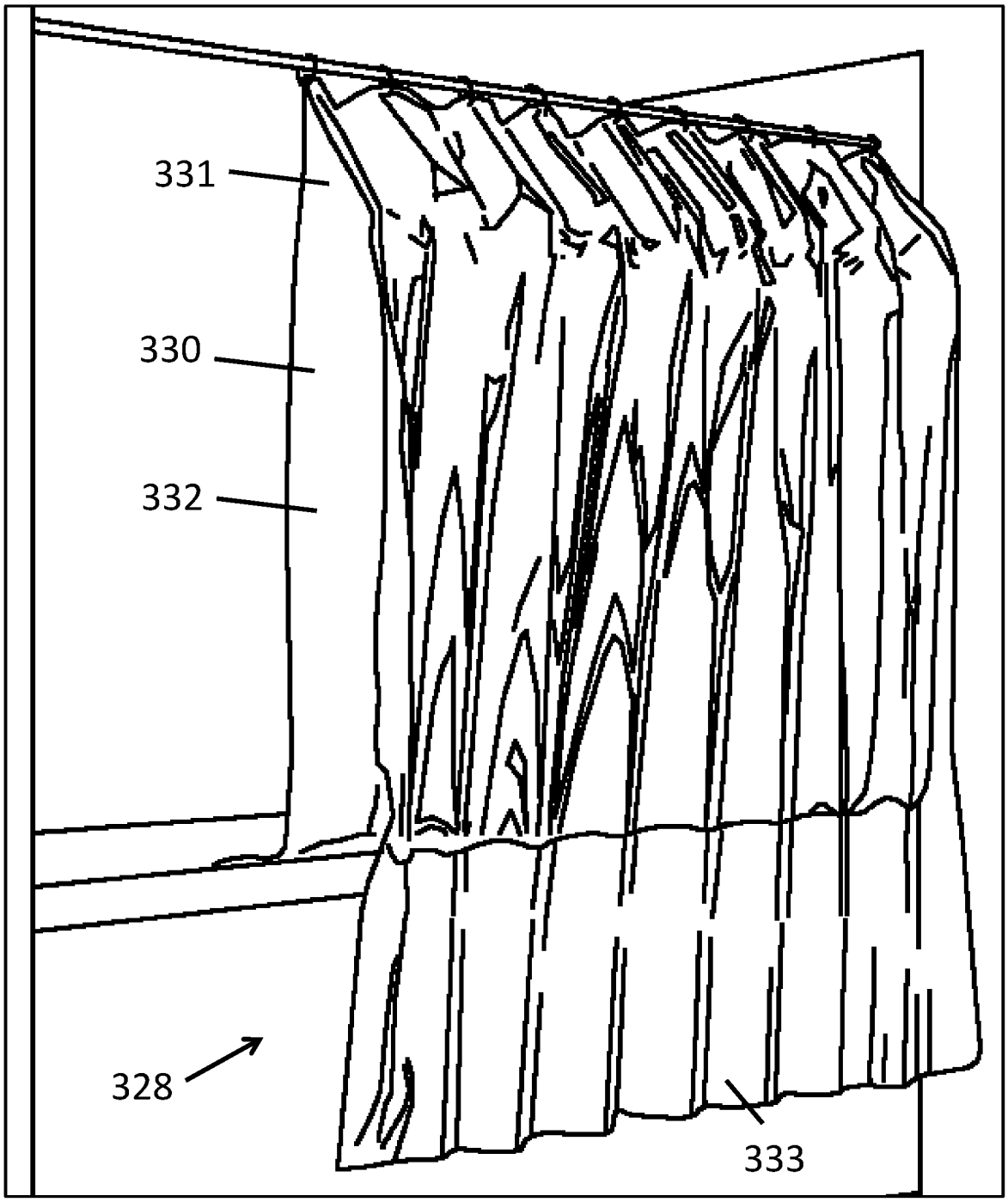
FIG. 31 is an outside perspective view of an implementation of a shower curtain liner assembly in a partially collapsed configuration.

FIG. 31 shows an outer view of a shower curtain liner assembly 328 which includes a liner 330 and a curtain 333. The assembly of FIG. 31 is in a partially collapsed configuration. The rigid members are not seen, but the viewer can determine their locations as they provide the angled configuration towards the top of the assembly. The liner is seen to have corner portions 331 and side panels 332 that are angled inwards, similar to the corner portions and side panels previously described (only one corner portion and side panel are shown in FIG. 31 but they are on both distal ends of the liner), which are useful in preventing water from escaping the shower when the assembly is placed in the fully expanded configuration (i.e., with the shower curtain liner assembly fully closed during showering).

Figure 32:
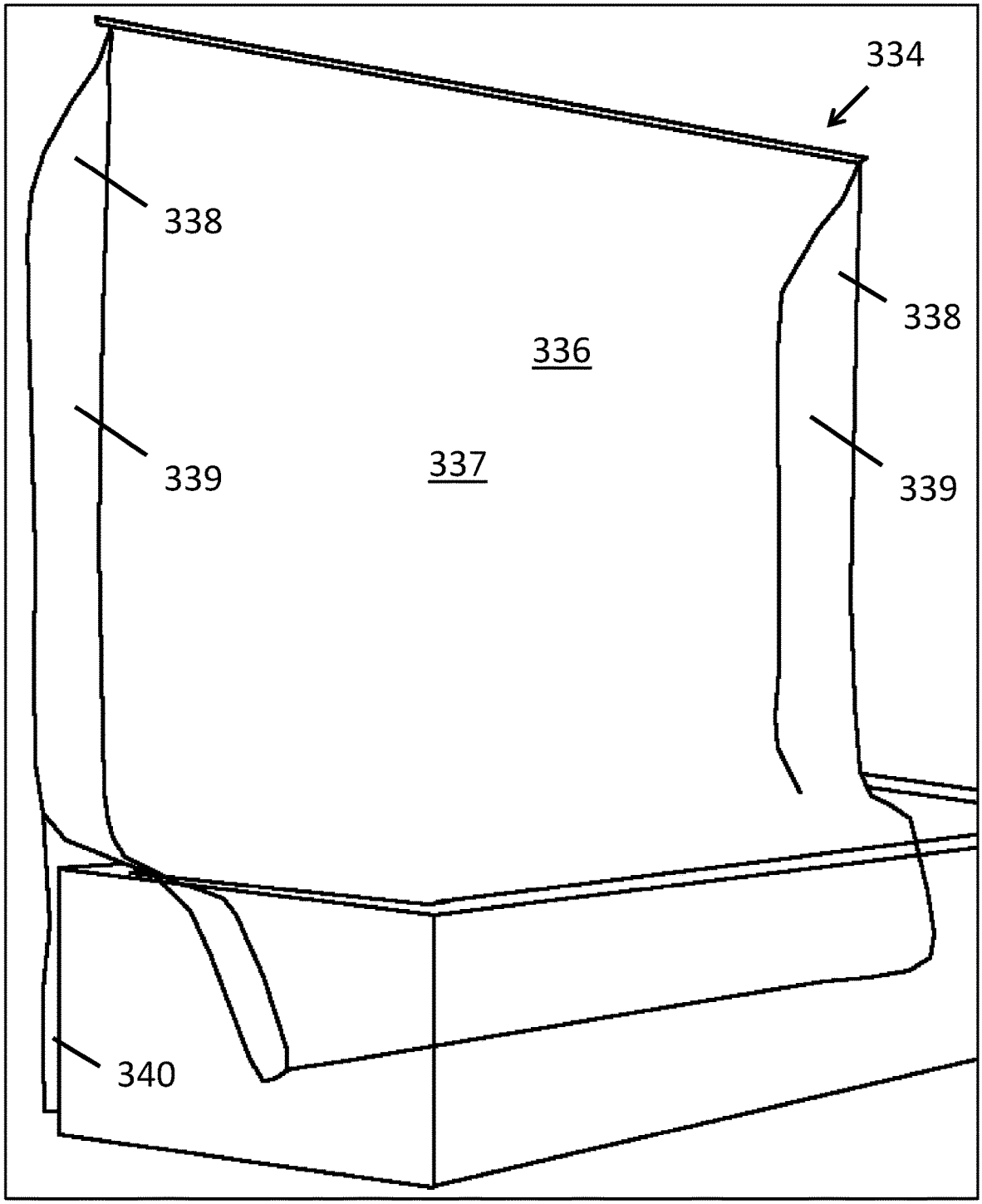
FIG. 32 is an inside perspective view of an implementation of a shower curtain liner assembly in a fully expanded configuration.

FIG. 32 shows an inner view of a shower curtain liner assembly 334 which includes a liner 336 and a curtain 340. The assembly of FIG. 32 is in a fully expanded configuration (i.e., the configuration the assembly would be in during showering). The rigid members are not seen, but they provide the angled shape towards the top of the liner where the liner is positioned away from the tub and, in implementations, the angled shape towards the bottom of the liner where the liner angles back in towards the tub. The liner is seen to have corner portions 338 and side panels 339 that are angled inwards on both distal ends of the liner, similar to the corner portions and side panels previously described, which are useful in preventing water from escaping the shower when the assembly is placed in the fully expanded configuration. In FIG. 32 the corner portions 338 and side panels 339 are angled 90 degrees or about 90 degrees relative to the largest planar surface 337 of the liner when the liner is in the fully extended configuration. The term "about 90 degrees" as used in this paragraph in implementations is meant to include a range of (and including) 60 degrees to 120 degrees, in other implementations is meant to include a range of (and including) 70 degrees to 110 degrees, and in other implementations is meant to include a range of (and including) 80 degrees to 100 degrees. In the implementation of FIG. 32 it is seen that the inwardly-angled side panels exist along more than half of the longest vertical length of the shower curtain liner.

In implementations, traditional prior art shower curtain assemblies may allow about 23 inches of space from the inner wall of the shower to the shower curtain liner. This amount of room may be reduced down to 14 inches when there is a draft near the shower, such as caused by the movement of the heated air near the hot water and colder air flowing downward towards the bottom of the tub. In implementations the shower curtain liner assemblies disclosed herein may increase the space between the inner wall of the shower and the shower liner to 29 inches or about 29 inches, 30 inches or about 30 inches, 32 inches or about 32 inches, 33 inches or about 33 inches, 35 inches or about 35 inches, 36 inches or about 36 inches, and so forth. When the term "about" is used with respect to these dimensions it is meant to convey a range of +/−two inches.

In implementations the shower curtain liner and the shower curtain could be attached to one another at the top and middle of each, for example heat sealing the two together so that they together form the sleeves for receiving the rigid members, but having the two not be sealed/attached to one another towards the bottom of each so that the liner can rest inside the tub while the curtain is draped outside the tub. In some implementations the liner may be made to look nice so that a separate curtain is not needed for aesthetic decoration, although in such implementations the liner will still reside inside the tub at the bottom of the liner to prevent water from exiting the tub. In implementations the sleeves may be tiny or, in other words, sized very close to the size of the rigid members themselves so that each rigid member is snug within its sleeve. Although hollow PVC pipes are shown in some implementations as being used for rigid members, in some implementations non-hollow polymer rigid members may be used which may have smaller diameters, and accordingly smaller sleeves may be used, which in implementations may result in greater aesthetic appeal of the assembly.

It is pointed out that, in implementations, the assemblies disclosed herein stop the liner from coming inward towards the user during showering and, accordingly, stop the liner from contacting the user during showering.

The rigid members disclosed herein may be made of any materials, including polymers (such as plastics or any other polymers), metals, wood or composite materials, and so forth.

Referring back to FIG. 1, it is pointed out that, in implementations, the shower curtain liner is kept in the desired place by the rigid member, but the rigid member is in turn kept in its desired place because of the combination of the top of each rigid member being kept at a relatively fixed distance from the curtain rod (though slidable along the rod, in implementations) while the bottommost portion of each rigid member is kept at a relatively fixed distance from the side of the tub (though again slidable along the side of the tub). This in implementations is because of gravitational force tending to rotate the bottom of each rigid member toward the tub, but the tub preventing rotation past the side of the tub itself. In other implementations the bottommost members of the rigid members may not contact the tub always during use, but the length of the rigid members, extending below the top of the tub, may still prevent the rigid members (and accordingly a portion of the liner) from swinging inward past the side of the tub and towards the inside of the tub/shower. Accordingly, the ability of the bottommost portion to abut the outer side of the tub, in implementations, facilitates keeping the middle of the liner in an outward position away from the person showering therein.

In implementations the liners disclosed herein may be used together with a shower curtain or alone without a shower curtain. When used with a curtain the liner is the portion that is inside towards the shower and gets wet, while the curtain is the outside portion that falls outside the tub. In implementations the curtain and liner may be one piece molded or otherwise formed or coupled together, while in other implementations they may be separate. As described above, the liners disclosed herein create more space in the interior of the shower area and keep the liner from touching the person showering.

The rigid members that position the shower curtain liner as previously described can be attached to the liner by adhesive, hook-and-loop fasteners, manufacturing them together (so that the liner and rigid members are integrally formed as a composite liner with rigid portions), using any material attached to the liner such as a band having a snap/button or other closure mechanism to secure to the rigid members, and/or any other mechanism herein disclosed or hereafter discovered. The combination of the liner and rigid members creates the benefit of more space in the shower, and/or provides a no-touch shower curtain liner. This increases hygiene and decreases anxiety by preventing the liner from touching the person showering, preventing bacteria and the like from contacting the user's skin, and so forth.

It is disclosed above that the liners with corner portions and side panels help to prevent water from exiting the shower during showering. In implementations a standard liner without the corner portions and side panels would allow water to exit the shower during showering because of gaps at both distal ends of the liner (the end towards the shower head and the end away from the shower head) between the liner and the sidewalls of the shower walls. A normal shower liner is longer than the width of the shower enclosure, for instance a normal shower enclosure may have a width of 60 inches, but a normal shower liner may be 72 inches in width. In implementations a liner of this size and, in general, a liner that is wider than the shower enclosure, will not work as desired with the assemblies disclosed herein because they will not be pulled taut when fully expanded, as discussed above, and will also not have the corner portions and side panels to prevent water from exiting the shower. Accordingly, in implementations the liners disclosed herein have a width that is shorter than the width of the shower enclosure—for instance about 1.5 inches shorter—with extra length being curved inward at the ends due to the corner portions and side panels, due to the cuts and bonded portions (for example as described with respect to FIGS. 7A-8 and other implementations), to prevent water from escaping the shower during use. This allows the user to fully extend the liner to the most expanded position which will pull the assembly taut and tend to bias the rigid members to the desired positions to provide the most amount of additional space with the assembly. In implementations, shower curtain liner assemblies disclosed herein are configured so that neither end of the liner touches the shower walls, due to the liner width being shorter than the shower width, but the corner portions and side panels still help to prevent water from exiting the shower during use. In other word, in implementations a greatest width of the shower curtain liner is shorter than a greatest width of the shower so that, when the shower curtain liner is fully expanded, distal sides of the shower curtain liner do not touch any walls of the shower.

In implementations the rigid members may be removed from the liner (for example slid out of sleeves or bands or otherwise detached therefrom) so the use can wash the liner and/or rigid members, replace the liner and/or rigid members, and so forth. As disclosed above, the rigid members may be made in different sizes (for example the differently-sized rigid members of FIGS. 25-27) to create different amounts of additional space within the shower. In implementations the liner(s) may be custom sized to fit a specific size of rigid members to accommodate the appropriate amount of additional space within the shower and to still allow the liner to drape within the tub at the bottom of the liner to prevent water from exiting the shower.

When manufacturing the liner and rigid members as a single composite component a polymer or plastic (such as vinyl, as a non-limiting example) may be molded or otherwise formed so that most of the liner is thin for flexibility but thicker portions are also molded/formed to create the rigid members, including rigid portions extending down the length (or a portion of the length) of the liner and/or also at the top where the liner will couple with the rod.

As disclosed herein, the rigid members may be held in place by hanging them from shower curtain/liner rod rings, as an example. The rigid members can also be held in place by hanging them directly from the shower rod by forming the top of the rigid members into a hook or loop or the like to loop around and/or hang on the rod directly. In other implementations hooks or loops or the like may be hung from the rod and the rigid members may be hung thereon instead of directly on the rod. In still other implementations the rigid members may hang through a slit or track of the hollow shower rod and be slidable therein, as discussed above.

In implementations in which the rigid members themselves have openings/holes or loops at their tops, for receiving or coupling with a hook or loop for hanging on a rod (such as in FIGS. 11-14A, 16, 18 and as described with respect to FIGS. 25-27), or integral hook/loop elements for hanging on a hook (such as in FIG. 15), such elements may prevent the rigid members from rotating (or prevent the rigid members from rotating beyond some angular rotation, for example preventing rotation greater than 5 to 15 degrees of the top angled portion of the rigid member away from a 90-degree angle) relative to the shower rod. In FIG. 15, for example the angled portion of the rigid member forms an angle of 90 degrees relative to the shower rod because the top angled portion is angled at an angle perpendicular to the longest length of the shower rod, whereas if the rigid member were to rotate to some extent on the shower rod it would rotate away from the exact 90-degree configuration. Such configurations help the rigid member to stay in its space-creating configuration always, always pulling the liner away from the inside of the shower, as opposed to those versions which allow the rigid members to lay down to the side when the liner is not taut, discussed above.

In other words, the rigid members may be hung from shower curtain/liner rings, from the liner itself, or from the curtain rod, in implementations. Hook-and-loop fasteners may be adhered to the rigid members and to the liner (or double-sided tape, an adhesive, magnets, etc. may be used) to convert an existing shower liner and get a similar effect as with the other liners disclosed herein. This may allow the rigid member elements to be sold separately from the liner, so that the user may select the liner of their choice or, otherwise, attach the rigid members to any existing liner.

It is noted that none of the assemblies disclosed herein include horizontal rigid members, but only vertical rigid members. This is so that the liners can easily/quickly be collapsed as desired for the user to enter/exit the shower/tub—with horizontal rigid members it would take the user longer to enter the shower/tub and/or the user would need to remove/replace the horizontal rigid members each time it is desired to use the shower/tub.

Although in implementations the tops of the liners include a corner portion which forces the liner to form side panels, as discussed above, in implementations there is nothing towards the bottom of the liners to force such an angle but, instead, only the top corner portion forces the angling inward of the side panels. Additionally, there are no horizontal rigid members forcing the liner inward, but instead only vertical rigid members are used. The use of only vertical rigid members, and of the corner portion and side panels, allows the assemblies to be easily opened/closed for entrance to and exit from the shower but, also, prevents water from exiting the shower when the assembly is in use.

In the drawings it is seen that the vertical portion of the rigid members is positioned below the angled portion—this is useful to pull the liner away from the inside of the shower up at the top of the liner closer to the shower rod, to provide increased space for the user while showering. It is also seen that the lowermost angled portion, in the implementations with lower angled portions, is positioned below the vertical portion. This also serves to increase the space for the user while showering, so that the liner is pulled away from the user for the full length of the vertical portion.

As used herein the term "longest length" means the length of greatest magnitude of an element or component among all lengths of the element/component in all directions.

In implementations the "side panels" discussed herein exist along more than half of the vertical length of the liner.

In places where the phrase "one of A and B" is used herein, including in the claims, wherein A and B are elements, the phrase shall have the meaning "A or B." This shall be extrapolated to as many elements as are recited in this manner, for example the phrase "one of A, B, and C" shall mean "A, B, or C," and so forth.

In places where the description above refers to specific implementations of shower curtain liner assemblies and related methods, one or more or many modifications may be made without departing from the spirit and scope thereof. Details of any specific implementation/embodiment described herein may, wherever possible, be applied to any other specific implementation/embodiment described herein.

What is claimed is:

1. A shower curtain liner assembly, comprising:

a shower curtain liner comprising a plurality of openings configured to be used to hang the shower curtain liner from a shower rod;

a plurality of rigid members; and a plurality of couplers coupled with the shower curtain liner and configured to couple the rigid members to the shower curtain liner in a vertical configuration so that a longest length of each rigid member is perpendicular to the shower rod when the shower curtain liner is hanging from the shower rod;

wherein each rigid member comprises a first angled portion and a vertical portion and wherein, when the rigid member is coupled with one or more of the couplers and when the shower curtain liner is hanging from the shower rod:

the first angled portion is angled away from an interior of a shower;

the shower curtain liner is positioned away from the interior of the shower by the first angled portion;

the vertical portion is parallel with a sidewall of a tub of the shower; and the vertical portion is positioned further from the shower rod than the first angled portion; and wherein the first angled portion of each rigid member is adjustable within a range of angles using a variable-angled connector connecting a first portion of the rigid member and a second portion of the rigid member.

2. The assembly of claim 1 wherein, when each rigid member is coupled with one or more of the couplers and when the shower curtain liner is hanging from the shower rod, a lowermost extremity of each rigid member abuts an outside surface of the tub.

3. The assembly of claim 1 wherein the shower curtain liner assembly comprises no horizontal rigid members having a longest length parallel with the shower rod.

4. The assembly of claim 1 wherein at least one of the rigid members comprises a second angled portion and wherein, when each rigid member is coupled with one or more of the couplers and when the shower curtain liner is hanging from the shower rod, the second angled portion is positioned further from the shower rod than the vertical portion of the at least one rigid member, the second angled portion is angled towards the tub, and a lowermost extremity of the second angled portion abuts an outside surface of the tub.

5. The assembly of claim 1 wherein, when each rigid member is coupled with one or more of the couplers and when the shower curtain liner is hanging from the shower rod, none of the rigid members comprises a second angled portion positioned further from the shower rod than its vertical portion.

6. The assembly of claim 1 wherein each rigid member comprises an opening configured to be used to hang the rigid member from the shower rod.

7. The assembly of claim 1 wherein each rigid member comprises a loop, wherein the loop is configured to hang from one of the shower rod and an element looped around the shower rod.

8. The assembly of claim 1 wherein at least one of the rigid members comprises a hook member configured to hang one of the shower curtain liner and a shower curtain thereon.

9. The assembly of claim 1 wherein a greatest width of the shower curtain liner is shorter than a greatest width of the shower so that, when the shower curtain liner is fully expanded, distal sides of the shower curtain liner do not touch any walls of the shower.

10. The assembly of claim 1 wherein the couplers comprise one of sleeves, hook-and-loop fasteners, and straps.

11. The assembly of claim 1 wherein the shower curtain liner comprises two corner portions angled inward towards the shower when the shower curtain liner is hanging from the shower rod, the corner portions forming an angle between 60 and 120 degrees with a largest planar surface of the shower curtain liner in a fully expanded configuration.

12. The assembly of claim 1 wherein the shower curtain liner comprises side panels angled inward towards the shower when the shower curtain liner is hanging from the shower rod, the side panels forming an angle between 60 and 120 degrees with a largest planar surface of the shower curtain liner in a fully expanded configuration, the side panels existing along more than half of a longest vertical length of the shower curtain liner.

13. A shower curtain liner assembly, comprising:

a shower curtain liner comprising a plurality of openings configured to be used to hang the shower curtain liner from a shower rod;

a plurality of rigid members; and a plurality of couplers coupled with the shower curtain liner and configured to couple the rigid members to the shower curtain liner in a vertical configuration so that a longest length of each rigid member is perpendicular to the shower rod when the shower curtain liner is hanging from the shower rod;

wherein each rigid member comprises a first angled portion and a vertical portion and wherein, when the rigid member is coupled with one or more of the couplers and when the shower curtain liner is hanging from the shower rod:

the first angled portion is angled away from an interior of a shower;

the shower curtain liner is positioned away from the interior of the shower by the first angled portion;

the vertical portion is parallel with a sidewall of a tub of the shower; and the vertical portion is positioned further from the shower rod than the first angled portion; and wherein each rigid member comprises a head atop a neck, the neck being narrower than the head, wherein the head is configured to retain the neck of the rigid member within a slot of the shower rod.

14. The assembly of claim 13 wherein the shower curtain liner comprises two corner portions angled inward towards the shower when the shower curtain liner is hanging from the shower rod, the corner portions forming an angle between 60 and 120 degrees with a largest planar surface of the shower curtain liner in a fully expanded configuration.

15. A shower curtain liner assembly, comprising:

a shower curtain liner comprising a plurality of openings configured to be used to hang the shower curtain liner from a shower rod;

a plurality of rigid members; and a plurality of couplers coupled with the shower curtain liner and configured to couple the rigid members to the shower curtain liner in a vertical configuration so that a longest length of each rigid member is perpendicular to the shower rod when the shower curtain liner is hanging from the shower rod;

wherein the shower curtain liner comprises two corner portions angled inward towards a shower when the shower curtain liner is hanging from the shower rod, the corner portions forming an angle between 60 and 120 degrees with a largest planar surface of the shower curtain liner in a fully expanded configuration;

wherein, when each rigid member is coupled with one or more of the couplers and when the shower curtain liner is hanging from the shower rod, a lowermost extremity of each rigid member abuts an outside surface of a tub of the shower; and wherein a first angled portion of each rigid member is adjustable within a range of angles using a variable-angled connector connecting a first portion of the rigid member and a second portion of the rigid member.

16. The assembly of claim 15 wherein the shower curtain liner comprises side panels angled inward towards the shower when the shower curtain liner is hanging from the shower rod, the side panels forming an angle between 60 and 120 degrees with the largest planar surface of the shower curtain liner in the fully expanded configuration, the side panels existing along more than half of a longest vertical length of the shower curtain liner.

17. The assembly of claim 15 wherein each rigid member comprises a first angled portion and a vertical portion and wherein, when the rigid member is coupled with one or more of the couplers and when the shower curtain liner is hanging from the shower rod: the first angled portion is angled away from an interior of the shower; the shower curtain liner is positioned away from the interior of the shower by the first angled portion; the vertical portion is parallel with a sidewall of the tub; and the vertical portion is positioned further from the shower rod than the first angled portion.

18. A shower curtain liner assembly, comprising:

a shower curtain liner;

a plurality of rigid members permanently integrally formed in the shower curtain liner; and a plurality of openings formed in the shower curtain liner configured to facilitate hanging of the shower curtain liner from a shower rod;

wherein, when the shower curtain liner is hanging from the shower rod, each rigid member positions a portion of the shower curtain liner away from an interior of a shower; and wherein each rigid member comprises a head atop a neck, the neck being narrower than the head, wherein the head is configured to retain the neck of the rigid member within a slot of the shower rod.

19. The assembly of claim 18 wherein, when the shower curtain liner is hanging from the shower rod, a lowermost extremity of each rigid member abuts an outside surface of a tub of the shower.

20. The assembly of claim 18 wherein each rigid member comprises a first angled portion and a vertical portion and wherein, when the shower curtain liner is hanging from the shower rod: the first angled portion is angled away from the interior of the shower; the vertical portion is parallel with a sidewall of a tub of the shower; and the vertical portion is positioned further from the shower rod than the first angled portion.

* * * * *